US008329374B2

(12) United States Patent
Inoue et al.

(10) Patent No.: US 8,329,374 B2
(45) Date of Patent: Dec. 11, 2012

(54) CARRIER, PRODUCTION METHOD THEREOF, DEVELOPER AND IMAGE FORMING METHOD

(75) Inventors: Ryota Inoue, Mishima (JP); Akihiro Kotsugai, Numazu (JP); Yoshihiro Moriya, Numazu (JP); Shingo Sakashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 956 days.

(21) Appl. No.: 12/347,322

(22) Filed: Dec. 31, 2008

(65) Prior Publication Data

US 2009/0186292 A1 Jul. 23, 2009

(30) Foreign Application Priority Data

Jan. 18, 2008 (JP) ..... 2008-009404

(51) Int. Cl.
*G03G 9/113* (2006.01)

(52) U.S. Cl. ..... 430/137.13; 430/111.35

(58) Field of Classification Search ..... 430/137.13
See application file for complete search history.

(56) References Cited

U.S. PATENT DOCUMENTS

| | | | | |
|---|---|---|---|---|
| 5,514,512 | A | 5/1996 | Cunningham et al. | |
| 5,516,618 | A * | 5/1996 | Cunningham et al. | 430/137.13 |
| 6,051,354 | A * | 4/2000 | Veregin et al. | 430/137.13 |
| 6,391,509 | B1 * | 5/2002 | Drappel et al. | 430/137.13 |
| 6,472,118 | B1 | 10/2002 | Yamaguchi et al. | |
| 6,599,672 | B2 | 7/2003 | Yamaguchi et al. | |
| 6,739,534 | B2 | 5/2004 | Yamaguchi et al. | |
| 6,743,558 | B2 | 6/2004 | Yamaguchi et al. | |
| 6,939,654 | B2 | 9/2005 | Kotsugai et al. | |
| 7,192,679 | B2 | 3/2007 | Yamaguchi et al. | |
| 7,320,852 | B2 | 1/2008 | Kotsugai et al. | |
| 7,348,121 | B2 | 3/2008 | Inoue et al. | |
| 2007/0059626 | A1 | 3/2007 | Inoue et al. | |
| 2008/0138734 | A1 * | 6/2008 | Inoue et al. | 430/137.13 |
| 2008/0227002 | A1 | 9/2008 | Moriya et al. | |
| 2008/0280224 | A1 | 11/2008 | Inoue et al. | |

FOREIGN PATENT DOCUMENTS

| | | |
|---|---|---|
| JP | 55-127569 | 10/1980 |
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 2626754 | 4/1997 |
| JP | 9-269614 | 10/1997 |
| JP | 9-319161 | 12/1997 |
| JP | 10-186731 | 7/1998 |
| JP | 2006-106208 | 4/2006 |
| JP | 2007-248922 | 9/2007 |
| JP | 2008-281850 | 11/2008 |

OTHER PUBLICATIONS

English language machine translation of JP 2006-106208 (Apr. 2006).*
English language machine translation of JP 2007-248922 (Sep. 2007).*
Hay, J.N. et al. "Review: Environmentally friendly coatings using carbon dioxide as the carrier medium" Journal of Material Science, vol. 37, pp. 4743-4752 (2002).*

* cited by examiner

*Primary Examiner* — Christopher Rodee
(74) *Attorney, Agent, or Firm* — Oblon, Spivak, McClelland, Maier & Neustadt, L.L.P.

(57) ABSTRACT

There is provided a method for producing a carrier, which includes depositing a resin coating layer on the surface of a magnetic material; adding a treatment agent for a conductor precursor to the resin coating layer so as to treat the resin coating layer with the treatment agent; and exposing the treatment agent-added resin coating layer to a conductor precursor in a supercritical or subcritical fluid so as to form a conductor in the resin coating layer.

9 Claims, 5 Drawing Sheets

CARRIER, PRODUCTION METHOD THEREOF, DEVELOPER AND IMAGE FORMING METHOD

BACKGROUND OF THE INVENTION

1. Field of the Invention

The present invention relates to a carrier for developing a latent electrostatic image suitable for use in electrophotography, electrostatic recording, electrostatic printing and other imaging processes and a method for producing such a carrier. The present invention further relates to a developer using such a carrier and an image forming method using the developer.

2. Description of the Related Art

The dry development process used in electrophotography is a process in which toner rubbed against a charged member is electrostatically attached to a latent electrostatic image-bearing member to form a visible image. There are two types of the dry development process: one is the single-component development system that primarily uses toner, and the other is the two-component development system that uses a mixture of toner and a carrier, such as glass beads, magnetic carrier or any of such carriers coated with a resin or other coatings.

A typical developer used in the two-component development system is composed of relatively large particles of a core material (i.e., carrier) that have smaller toner particles attached to their surface by the action of electrostatic force resulting from friction between the two components. As the developer comes in the proximity of a latent electrostatic image, the attraction acting on the toner that is caused by the electric field of the latent electrostatic image becomes stronger than the attraction between the toner and the core material. As a result, the toner is attracted to the latent electrostatic image, developing it into a visible image. Subsequently, the developer is repeatedly used by replacing the toner consumed during the development process.

Thus, the core material must be sufficiently charged by friction in order to retain a polarity that attracts toner during the extended use. However, collisions between the particles, mechanical stirring of the particles in the development apparatus and the heat generated in these processes can lead to a phenomenon known as "spent toner" in which the toner is fused to the surface of the core material. If spent toner occurs, the charge performance of the core material will decrease during use, resulting in smears in the resulting images and toner scattering. Consequently, the whole developer must be replaced.

One approach to prevent spent toner is by coating the surface of the core material with a fluorine resin, silicone resin or other resins that have a low surface energy. This significantly extends the life of the carrier. Examples of such carriers include a carrier coated with a room-temperature-setting silicone resin and a positively chargeable nitrogen resin (See, Japanese Patent Application Laid-Open (JP-A) No. 55-127569), a carrier coated with a coating material containing at least one modified silicone resin (See, JP-A No. 55-157751), a carrier having a coating layer containing a room-temperature-setting silicone resin and a styrene-acrylic resin (See, JP-A No. 56-140358), a carrier formed of core particles coated with two or more layers of silicone resin, the layers being not adhered to one another (See, JP-A No. 57-96355), a carrier formed of core particles surface-treated or coated with a polyvinyl acetal resin cross-linked with an isocyanate (See, JP-A No. 57-96356), a carrier coated with a silicone resin containing silicon carbide (See, JP-A No. 58-207054), a positively chargeable carrier coated with a material having a critical surface tension of 20 dyn/cm or less (See, JP-A No. 61-110161), and a developer composed of a carrier coated with a coating material containing a fluoroalkyl acrylate and a toner containing a chromium-containing azo dye (See, JP-A No. 62-273576).

Recently, smaller toner particles are being developed to further improve the quality of images. However, such smaller toner particles tend to fuse to carrier particles, leading to spent toner. In addition, the conventional spray coating technique is ineffective in uniformly wetting the carrier surface with a coating material, so that it is now difficult to manufacture carriers that have good adhesion between the coating layer and the core material and that have uniform coating thickness and uniform coating quality.

Furthermore, full-color toners tend to fuse to a carrier in larger amounts than black toners because of the low-softening point resins that are used in these toners to achieve sufficient color tones. This also leads to spent toner and can result in a decreased amount of charge that can be stored by the toner, as well as toner scattering and smears. The decrease in toner charge in a full-color electrophotographic system can result in varied image density in highlights, so that high image quality can no longer be maintained.

In general, when a carrier with high electrical resistance is used in a developer, the resulting image, especially when it is a large area photocopied image, would exhibit an "edge effect," meaning that the image density is very low near the center of the image and high near the periphery of the image. While the edge effect serves to make an image sharp when the image is made up with characters and thin lines, medium tone images will have very poor reproducibility due to the same effect. For these reasons, there is a need to adequately control the electrical characteristics of carrier particles, in particular those used with full-color toners, in order to enable formation of high-quality medium tone images with sufficient color tones.

To improve the durability of carriers and facilitate formation of high-quality images, it has been proposed to control the anti-spent-toner property, coating strength and electrical characteristics of carrier by providing a coating layer composed of fine particles and a conductivity agent dispersed in a resin matrix of a low surface energy material (See, JP-A No. 09-319161, JP-A No. 09-269614, and JP-A No. 10-186731). However, each of these approaches involves applying a dispersion of the fine particles in an organic solvent at high temperature by spray coating. This causes the fine particles to aggregate, thus making it difficult to achieve uniform charge.

It has also been proposed to control the electrical resistance of the carrier surface by depositing on the surface of core material a coating layer composed of a conductive polymer to serve as a conductivity agent dispersed in a resin (Japanese Patent (JP-B) No. 2626754). According to this approach, however, the undesirable compatibility between the resins makes it difficult to disperse the conductive polymer in the coating layer uniformly enough to achieve stable resistance.

In addition, organic solvents used in conventional spray coating to deposit the coating layer on the surface of core material generate volatile organic chemicals (VOCs), for which regulations have been established. Conventional spray coating has additional problems associated with it, such as liquid wastes and energy required to dry the coating.

One approach to these problems is to produce carrier particles in an organic solvent-free, dry powder process. One such process uses a supercritical fluid (See, U.S. Pat. No. 5,514,512). However, this process, in which a coating resin polymerized in a supercritical fluid is melted by heating for coating, does not provide a solution to the problem of spent toner since the coating resin is an acrylic resin.

JP-A No. 2006-106208 also concerns a production method of carriers using a supercritical fluid in which the coating material is a silicone resin. In this method, the poor solubility of the silicone resin in the supercritical fluid makes it necessary to plasticize and micro-disperse the silicone resin. The dispersed resin is sprayed with a core material to coat the core material with the resin. The resulting coating layer has non-uniform thickness and is not thick enough to achieve the desired durability. Moreover, a conductivity agent is dispersed in the resin matrix by kneading, so that the conductivity agent is not thoroughly micro-dispersed. Thus, this method fails to provide a solution to the above-described problem of non-uniform composition caused by aggregation.

Therefore, no satisfactory technology has been developed to date for the production of carriers that have a coating layer with uniform thickness and achieve good adhesion between the core material and the coating layer, nor has any relevant technology been developed. From the viewpoint of environmental load and saving resources, there are still many problems associated with conventional carriers and production methods thereof that need to be addressed.

BRIEF SUMMARY OF THE INVENTION

The present invention has been devised in view of the aforementioned problems. Accordingly, it is an objective of the present invention to provide a carrier that achieves good adhesion between its core material and resin coating layer, has resin coating layer with uniform thickness, and has high mechanical strength, as well as a method for producing such a carrier. It is another objective of the present invention to provide a developer using the above-described carrier that does not cause toner scattering or background deposition in the resulting images, and can form precise, edge-effect-free images with high image density over a prolonged period of time, as well as an image forming method using such a developer.

The features of the present invention, which are means for solving the above-described problems, will be described hereinafter.

A method for producing a carrier of the present invention, includes: depositing a resin coating layer on a surface of a magnetic material; adding a treatment agent for a conductor precursor to the resin coating layer so as to treat the resin coating layer with the treatment agent; and exposing the treatment agent-added resin coating layer to a conductor precursor in a supercritical or subcritical fluid so as to form a conductor in the resin coating layer.

In the method for producing a carrier of the present invention, the step of depositing resin coating layer includes dissolving or dispersing a resin for the resin coating layer in a supercritical or subcritical fluid to deposit the resin coating layer on the surface of the magnetic material.

In the method for producing a carrier of the present invention, the conductor is metal particles.

In the method for producing a carrier of the present invention, the conductor precursor is an organic metal complex.

In the method for producing a carrier of the present invention, the conductor is a polymer.

In the method for producing a carrier of the present invention, the conductor precursor is a compound containing a 5-membered aromatic structure or an aniline structure.

In the method for producing a carrier of the present invention, the compound containing a 5-membered aromatic structure is pyrrole or a derivative of pyrrole.

In the method for producing a carrier of the present invention, the adding the treatment agent is carried out in a supercritical or subcritical fluid.

In the method for producing a carrier of the present invention, the supercritical or subcritical fluid is carbon dioxide.

A carrier of the present invention is produced by any of the above-described method producing a carrier of the present invention.

A developer of the present invention contains the above-described carrier and a toner.

An image forming method of the present invention, includes: forming a latent electrostatic image on a latent electrostatic image-bearing member; developing the latent electrostatic image using the above-described developer so as to form a visible image; transferring the visible image to a recording medium; and fixing the transferred image to the recording medium.

According to the above-described method for producing a carrier, a conductor is uniformly dispersed in the resin coating layer. Consequently, the method can effectively produce a carrier that not only has high mechanical strength, but also ensures high toner chargeability and high stability over time. In this method, a treatment agent that acts to convert a conductor precursor into the conductor is added to the resin coating layer. Specifically, the treatment agent acts such that the conductor is formed when the resin coating layer is exposed to the conductor precursor in a supercritical or subcritical fluid. In this manner, the conductor can be produced readily and effectively in an amount required to provide the resin coating layer with desired conductivity even when a material having a low solubility in the supercritical or subcritical fluid is used.

The above-described carrier can be mixed with a toner to form a developer that can be used to form images with high image density without causing toner scattering or background depositions.

The above-described image forming method involves the following steps: a latent electrostatic image-forming step in which a latent electrostatic image is formed on a latent electrostatic image-bearing member; a development step in which the latent electrostatic image is developed using the developer of the present invention so as to form a visible image; a transfer step in which the visible image is transferred to a recording medium; and a fixing step in which the image transferred to the recording medium is fixed.

According to this method, sharp, high-quality images with high image density can be obtained without causing toner scattering or background depositions.

According to the present invention, there is provided a carrier that has high mechanical strength and can solve the above-described problems associated with prior art technology, as well as a method for producing such carrier. According to the present invention, there is also provided a developer using the foregoing carrier that does not cause toner scattering or background depositions in the resulting images, and can form precise, edge-effect-free images with high image density over a prolonged period of time, as well as an image forming method using such a developer.

DETAILED DESCRIPTION OF THE INVENTION

Figure 1:
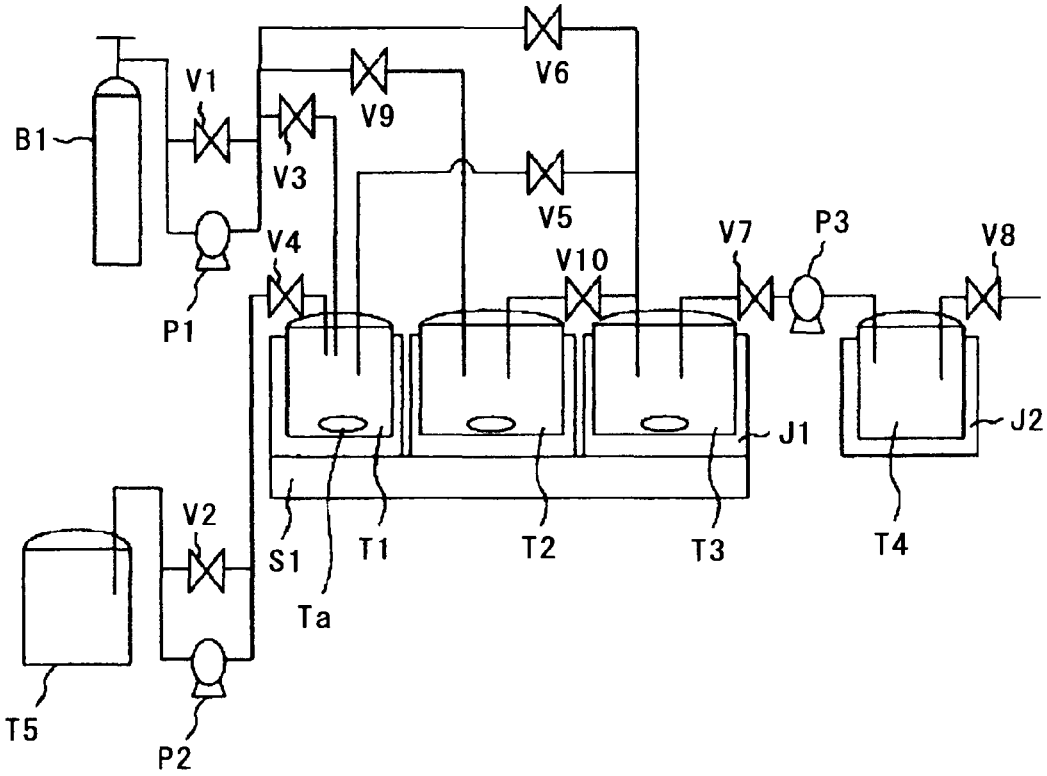
FIG. 1 is a schematic diagram of an exemplary apparatus used for the production of carrier of the present invention.

The best mode for carrying out the present invention will now be described with reference to the accompanying drawings. It should be appreciated that various changes and modifications are apparent to those skilled in the art and such changes and modifications are within the scope of the appended claims. The following description is intended to illustrate the best mode of the present invention by way of example only and should not be construed as a limitation to the scope of the appended claims.

(Carrier and Production Method Thereof)

A method for producing a carrier of the present invention includes at least a step of depositing a resin coating layer, a step of treating a resin coating layer and a step of forming a conductor, and other optional steps.

The carrier of the present invention is produced by the method of the present invention.

The method for producing carrier of the present invention is described in the following, as are the details of the carrier of the present invention.

In the following descriptions and present claims, a toner denotes a group of toner particles, and a carrier denotes a group of carrier particles. Moreover, a toner particle denotes a toner base particle added with external additives or the like. Furthermore, a core material in the descriptions of the carrier denotes either a single or group of particles, depending on the context, each of which will be a core of the resulted carrier particle and each surface of which is coated with a coating resin to form the carrier particle.

<Step of Depositing Resin Coating Layer>

The step of depositing resin coating layer is depositing a resin layer on a surface of a magnetic material. This can be done by using any technique that can deposit a resin coating layer on a surface of a magnetic material. Among the techniques suitable for this purpose are (1) applying at least a coating solution to the surface of the magnetic material using, for example, a fluidized bed coater, and heating the applied coated layer, and (2) dissolving or dispersing at least a coating resin in a supercritical or subcritical fluid. Of the two techniques, the technique of (2) can effectively produce carrier and is particularly preferred since the technique meets the VOC regulation, produces no liquid wastes, requires little energy for drying the coated layer.

<Supercritical or Subcritical Fluid>

A supercritical fluid is a fluid that has properties between those of a gas and a liquid: it can dissolve materials and transfer heat at a high rate comparable to a liquid and has a low viscosity similar to a gas. By changing the temperature or pressure of a supercritical fluid, its density, permittivity, solubility parameters, free volume and other physical properties can be significantly varied in a continuous manner. Also, supercritical fluids have extremely small surface tension as compared to organic solvents and can therefore follow or wet (i.e., contact) microscopic surface features.

The supercritical fluid for use in the present invention may be any fluid that exits as a non-condensable and high-density fluid at a temperature and pressure above the point at which it exists as both a gas and a liquid (i.e., critical point). In other words, the supercritical fluid for use in the present invention is a fluid at or above its critical temperature and at or above its critical pressure and is not condensed upon compression. While any supercritical fluid may be selected in the present invention depending on the desired purpose, those with a relatively low critical temperature and a relatively low critical pressure are preferred. The subcritical fluid for use in the present invention may be any fluid that exists as a high pressure liquid at a temperature and pressure near its critical point. Any supercritical fluid may be selected in the present invention depending on the desired purpose.

Examples of the supercritical or subcritical fluid for use in the present invention include carbon monoxide, carbon dioxide, ammonia, nitrogen, water, methanol, ethanol, ethane, propane, 2,3-dimethylbutane, benzene, chlorotrifluoromethane and dimethyl ether. Of these, carbon dioxide is particularly preferred for the following reasons: carbon dioxide can readily reach a supercritical state (critical pressure=7.3 MPa, critical temperature=31° C.); carbon dioxide is nonflammable and highly stable; carbon dioxide is a non-aqueous solvent and thus contributes to produce a carrier with hydrophobic surfaces; carbon dioxide immediately becomes a gas by simply adjusting the pressure back to atmospheric pressure (or releasing the pressure) and is therefore readily recyclable; and carbon dioxide is environmentally friendly since the resulting carrier does not need to be dried and no liquid waste is produced during the carrier production.

These supercritical or subcritical fluids may be used either individually or as a mixture. Two or more fluids may be used in combination as long as the mixed fluid maintains the characteristics of the supercritical or critical fluid.

Other fluids may be used in combination with the supercritical or subcritical fluid. Preferably, such other fluids are those that can facilitate control of the solubility of the coating resin in the supercritical or subcritical fluid. Preferred examples of such fluids include methane, ethane, propane and ethylene.

In addition, an entrainer (azeotropic agent) may be added to the supercritical or subcritical fluid. The presence of entrainer enhances the solubility of the coating resin. While any entrainer may be selected in the present invention depending on the desired purpose, polar organic solvents are preferred, including methanol, ethanol, propanol, butanol, hexane, toluene, ethyl acetate, chloroform, dichloromethane, ammonia, melamine, urea and thioethylene glycol. Of these, lower alcohols having 1 to 6, preferably 1 to 4 carbon atoms are poor solvents at room temperature and atmospheric pressure and are thus particularly preferred.

The amount of the entrainer present in a mixture of at least one of the supercritical fluid or the subcritical fluid with the entrainer is preferably in the range of 0.1% by mass to 10% by mass, and more preferably in the range of 0.5% by mass to 5% by mass. The trainer may not provide desired entrainer effects when present in an amount less than 0.1% by mass, whereas its properties as a liquid may become too strong to achieve the desired supercritical or subcritical state when the amount exceeds 10% by mass.

-Coating Resin-

The coating resin for use in the present invention may be any known resin selected to suit the desired purpose, including amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and fluorine-free monomers, and silicone resins. These resins may be used either individually or in combination. Of these, silicone resins are particularly preferred because of their significant effects.

The silicone resin for use in the present invention may be synthesized as desired or suitably selected from commercial products. Examples of such commercial products include KR271, KR255, KR220L and KR152 (each a straight-chained resin product manufactured by Shin-Etsu Chemical); and SR2400, SR2406, SR2410, SR213, 217 Flake Resin, 220 Flake Resin, 233 Flake Resin, 249 Flake Resin and Z-6018 Intermediate (each a product manufactured by Dow Corning Toray).

Alternatively, the silicone resin may be a modified silicone resin, such as KR206 (alkyd-modified), KR5208 (acryl-modified), ES1001N (epoxy-modified) and KR305 (urethane-modified) (each a product manufactured by Shin-Etsu Chemical); and SR2115 (epoxy-modified) and SR2110 (alkyd-modified) (each a product manufactured by Dow Corning Toray).

When necessary, the resin coating layer may further contain a silane-coupling agent, particles and a resistance adjuster.

-Magnetic Material-

The magnetic material for use in the present invention that serves as the core material may be any known magnetic material commonly used in two-component carriers for electrophotography and selected to suit the desired purpose. Preferred examples of such magnetic materials include ferrite, magnetite, iron and nickel. Such ferrites as Mn ferrites, Mn—Mg ferrites and Mn—Mg—Sr ferrites are preferred to conventional Co—Zn ferrites in consideration of environmental impact that has become an important social issue.

Preferably, the core material has a volume-average particle size of 20 μm or more to prevent the carrier from scattering and adhering to the latent electrostatic image-bearing member. More preferably, the core material has a volume-average particle size of 100 μm or less to prevent defective images caused by carrier streaks and other causes. Still more preferably, the core material has a volume-average particle size of 20 μm to 50 μm to meet the requirements of the recent trend toward high quality image.

In this respect, the volume-average particle size of the core material can be measured, for example, by using a MICROTRAC particle size analyzer SRA (manufactured by Nikkiso) set to detect a range of 0.7 μm to 125 μm.

According to the carrier production method of the present invention, the carrier may be produced by depositing the resin coating layer using any suitable apparatus selected to suit the desired purpose. An exemplary apparatus includes a pressure vessel to dissolve at least the coating material therein and a pressure pump to feed liquid carbon dioxide to the vessel. In one exemplary process, at least the coating resin is placed in the pressure vessel and liquid carbon dioxide is fed to the pressure vessel via the pressure pump to dissolve the coating resin in liquid carbon dioxide. Subsequently, the pressure of liquid carbon dioxide is released to decrease the temperature and the pressure back to room temperature and atmospheric pressure, respectively. This significantly decreases the solubility of the coating resin, resulting in the deposition of the resin coating layer on the surface of the core material. Since the liquid carbon dioxide turns into gaseous carbon dioxide, the removal of the solvent is unnecessary, nor is any liquid waste produced from washing, thus significantly decreasing the environmental load.

In the deposition step of the carrier production method of the present invention, an apparatus such as the one shown in FIG. 1 may be used to deposit the resin coating layer on the surface of the core material.

The apparatus of FIG. 1 includes a tank T1 for dissolving a coating agent (coating agent dissolving tank), a tank T2 for treating fine particles (fine particle treatment tank), a tank T3 for treating a carrier (carrier treatment tank), and a stirrer S1 that has the tanks T1, T2 and T3 arranged thereon. Each of the tanks T1, T2 and T3 contains a stir bar Ta and is covered by a temperature-controlling jacket J1.

The tank T1 contains a coating agent to deposit the resin coating layer. Carbon dioxide is introduced into the tank T1 from a carbon dioxide cylinder B1. To introduce carbon dioxide, valves V1, V3 are opened and a pressure pump P1 forces carbon dioxide into the tank T1. With valves V3 to V5 closed, the inside of the tank T1 is maintained, for example, at 25 MPa and 15° C. for 2 hours. When necessary, an entrainer (azeotropic agent) is fed from an entrainer tank T5 to the tank T1 by the action of a pressure pump P2. Valves V2, V4 are opened during the feeding of the entrainer.

As is the case with the tank T1, carbon dioxide is introduced into the tank T2 from the cylinder B1. This involves valves V1, V9 and the pressure pump P1.

Carbon dioxide is also introduced into the tank T3 from the cylinder B1. When valves V5, V7 are opened and a reducing pump P3 is activated, the coating agent is introduced from the tank T1 into the tank T3.

The inside of the tank T3 is maintained, for example, at 25 MPa and 40° C. for 0.5 hours. Subsequently, the valves V5 to V7 are opened and the reducing pump P3 is activated to allow the pressure inside the tank T3 to decrease to atmospheric pressure over a time period of 2 hours. The valves V5 to V7 are then closed and the content of the tank T3 is heated at 160° C. for 2 hours to give the desired carrier.

The carrier so produced is collected in a tank T4 for collecting raw materials (raw material collection tank) by opening the valve V7 and activating the reducing pump P3. The tank T4 is covered by a cooling jacket J2. The carrier within the tank T4 is sent to the outside via a valve V8.

Unused coating resin and core material can be collected from the tank T3 and tank T4 for recycling.

<Step of Treating Resin Coating Layer>

The step of treating the resin coating layer is adding a treatment agent for a conductor precursor to the resin coating layer so as to treat the resin coating layer with the treatment agent.

The treatment agent can be considered to be "added" to the resin coating layer as long as it is present in or on the resin coating layer in one way or another. For example, the treatment agent may be present at the surface of the resin coating layer, or a part or all of the treatment agent may be incorporated in the resin coating layer, or it may be present in the resin coating layer in any combination of these forms. Preferably, the treatment agent is incorporated in the resin coating layer and, more preferably, it is uniformly dispersed in the resin coating layer.

In one example of the treatment step, the resin coating layer of the carrier is treated with a reducing agent that can reduce a metal particle precursor to add the reducing agent to the resin coating layer.

In such a case, the reducing agent can be considered to be "added" to the resin coating layer as long as it is present in or on the resin coating layer in one way or another. For example, the reducing agent may be present at the surface of the resin coating layer, or part or all of the reducing agent may be incorporated in the resin coating layer, or it may be present in the resin coating layer in any combination of these forms. Preferably, the reducing agent is incorporated in the resin coating layer and, more preferably, it is uniformly dispersed in the resin coating layer.

-Treatment of Resin Coating Layer-

To treat the resin coating layer, the resin coating layer of the carrier is first treated with a treatment agent for a conductor precursor. This can be carried out under any condition that can provide a conductive resin coating layer having a conductor uniformly dispersed therein and having a high conductivity and that is selected to suit the desired purpose.

The treatment agent for conductor precursor may be used in any amount that can provide a desired conductive resin coating layer in the subsequent conductor-forming step and that is selected to suit the desired purpose.

While the resin coating layer may be treated with the treatment agent for conductor precursor under any pressure that is higher than or equal to the critical pressure of the above-described supercritical or subcritical fluid used and that is selected to suit the desired purpose, it is preferably treated under a pressure of 1 MPa to 60 MPa, and more preferably under a pressure of 5 MPa to 40 MPa.

While the resin coating layer may be treated with the treatment agent for conductor precursor at any temperature that is higher than or equal to the critical temperature of the above-described supercritical or subcritical fluid used and that is selected to suit the desired purpose, it is preferably treated at a temperature of 35° C. to 90° C. when, for example, carbon dioxide is used.

The resin coating layer may be treated with the treatment agent for conductor precursor for any period of time that can provide a desired conductive resin coating layer and that is selected depending on the type of the resin of the resin coating layer and the amount of the conductor precursor used relative to the amount of the resin coating layer: for example, the treatment is preferably carried out for a period of time of 1 min to 120 min, and more preferably for a period of time of 5 min to 60 min. When necessary, the reaction system may be stirred or the high pressure vessel may be agitated during the treatment.

After the resin coating layer has been treated with the treatment agent for a conductor precursor, the treated carrier can be taken out of the high pressure vessel by slowly discharging the solvent in the high pressure vessel out of the vessel. The resulting carrier may then be exposed to a conductor precursor so that the conductor precursor is converted into a conductor within the resin coating layer.

Alternatively, the carrier may be exposed to the conductor precursor without taking it out of the high pressure vessel, but instead by adding the conductor precursor to the vessel.

-Treatment Agent for Conductor Precursor-

The treatment agent for conductor precursor for use in the present invention may be any agent that can convert the conductor precursor into a conductor and that is selected to suit the desired purpose.

The treatment agent must be selected depending on the conductor precursor for use. For example, the treatment agent may be an oxidizing agent when the conductor precursor is a polymer precursor that polymerizes into a polymer when oxidized. The treatment agent may be a reducing agent when the conductor precursor is an organic metal complex that is reduced to form a conductor.

The reducing agent may be any reducing agent that can reduce an organic metal complex to form a conductive metal and that is selected to suit the desired purpose. Examples include acrylamide, ϵ-caprolactam, nicotinamide, acetanilide, phenylacetamide, oleamide and oxamide.

The oxidizing agent may be any oxidizing agent that allows the conductor precursor to polymerize into a conductive polymer and that is selected to suit the desired purpose. Examples include transitional metal chlorides, such as ferric chloride and copper (II) chloride; permanganic acids, such as permanganic acid and permanganates; chromium oxides, such as chromium trioxide; nitrates, such as silver nitrate; halogen atoms, such as chlorine, bromine and iodine; peroxides, such as hydrogen peroxide and benzoyl peroxide; peroxo acid compounds, such as peroxodisulfate and potassium peroxodisulfate; hypochlorous acid compounds, such as hypochlorous acid, sodium hypochloride and potassium hypochloride; and metal oxides, such as silver oxide. Of these, transitional metal chlorides, halogen atoms and peroxo acid compounds are particularly preferred oxidizing agents since they also serve as dopants. These oxidizing agents may be used either individually or in combination.

The oxidizing agent may be used at any concentration that allows the conductor precursor to sufficiently polymerize. Such a concentration can be selected depending, for example, on the oxidizing agent for use.

The resin coating layer may be treated with the oxidizing agent at any temperature and for any period of time that are selected to suit the desired purpose.

<Step of Forming Conductor>

The step of forming a conductor is exposing the resin coating layer treated with the treatment agent to the conductor precursor in a supercritical or subcritical fluid to form a conductor in the resin conductive layer. As a result, the resin coating layer exhibits conductivity, or becomes a conductive material.

The conductor may be present at the surface of the resin coating layer, or a part or all of the conductor may be incorporated in the resin coating layer, or it may be present in the resin coating layer in any combination of these forms. Preferably, the conductor is uniformly dispersed in the resin coating layer.

Preferably, this step is carried out in a supercritical or subcritical fluid.

The supercritical or subcritical fluid may be the same as those used in the above-described step of depositing the resin coating layer involving supercritical or subcritical fluid. Following the deposition of resin coating layer, the resin coating layer is preferably treated with the conductor precursor in a carrier production apparatus as shown in FIG. 1.

In an alternative process, a coating solution containing at least a coating resin is applied to the surface of the core material using, for example, a fluidized bed coater. The applied coating is heated to form the resin coating layer. The core material having the resin coating layer deposited thereon is then treated with the conductor precursor in the supercritical or subcritical fluid.

-Conductor Precursor-

The conductor precursor may be any conductor precursor that is selected to suit to the desired purpose.

When the conductor is a metal, the conductor precursor is preferably an organic metal compound, such as metal alkoxides and metal complexes, that contains carbon-metal bonds in its molecule.

Examples of the metal alkoxide include aluminum triacetylacetonate, titanium tetraacetylacetonate and tetraethyl orthosilicate.

Examples of the metal complex include FOD (6,6,7,7,8,8,8-heptafluoro-2,2-dimethyl-3,5-octanedionate) complex of silver, acetylacetone complex of silver, acetylacetone complex of copper, acetylacetone complex of nickel, acetylacetone complex of platinum, acetylacetone complex of palladium and acetylacetone complex of aluminum.

Examples of metals in the metal alkoxides or metal complexes include silver (Ag), gold (Au), copper (Cu), titanium (Ti), silicon (Si), zinc (Zn), nickel (Ni), aluminum (Al), palladium (Pd), platinum (Pt), iron (Fe) and manganese (Mn).

When the conductor is a polymer, its precursor is preferably at least one selected from compounds containing, at least as a part thereof, a 5-membered aromatic structure or an aniline structure.

The compound containing a 5-membered aromatic structure as at least part thereof may be any compound with 5-membered aromatic structure selected to suit the desired purpose, including pyrrole, thiophene, furane, isoindole, isobenzofurane, isobenzothiophene and derivatives thereof. Examples of the derivative include N-methylpyrrole, 3-methylpyrrole, 3-methylthiophene, 3-methylfuran, 3-methylindole and pyrrole dimer. Oligomers of these compounds may also be used.

The compound containing an aniline structure as at least part thereof may be aniline, or an aniline compound substituted at at least one of ortho and meta positions with a halogen atom such as chlorine, bromine and iodine, an alkyl group such as methyl and ethyl, an alkoxy group such as methoxy and ethoxy, or an aryl group such as phenyl and tolyl. Oligomers of these compounds may also be used.

These compounds may be used either individually or in combination.

Of these, pyrrole, pyrrole dimer, pyrrole derivatives such as N-methylpyrrole and 3-methylpyrrole, and aniline are particularly preferred since they can provide the coating that remains unchanged and is stable in air.

Conversion of the conductor precursor into the conductor by the treatment with the treatment agent can be confirmed, for example, by observing the color change of the resin coating layer. For example, when the conductor precursor is pyrrole, the conversion of pyrrole into polypyrrole can be confirmed since the resin coating layer turns black in color as pyrrole polymerizes into polypyrrole. The conductivity of the resulting resin coating layer can be confirmed by measuring its electrical resistance.

The carrier obtained in the above-described manner (after formation of conductor) is preferably such that the Log R value of its measured electrical resistance is in the range of 7 Ω·cm to 16 Ω·cm when the carrier is intended for use in a two-component developer. The electrical resistance can be properly selected depending on the development process in which the carrier is used. If the Log R value is less than 7 Ω·cm, then the resulting image tends to have a notable variation in the image density caused by the brush shape of the carrier brush (magnetic brush) formed on a developer-bearing member. If the Log R value is greater than 16 Ω·cm, then defects may arise, such as the edge developing which causes a difference in the density between the edge area of the image and the solid area of the image, or between the line image and the solid image, the impaired development performance due to the undesirably charged carrier, and the carrier developing (adhering) which develops the areas where the latent electrostatic image is not to formed.

In this regard, the electrical resistance of the carrier can be determined, for example, by placing the carrier between two parallel electrodes, applying a voltage between the electrodes, and then measuring the current and voltage applied. Specifically, the carrier is packed in a container containing two parallel electrodes that are spaced apart by 2 mm. A voltage of 50 V is then applied between the two electrodes and the direct current resistance is measured by a resistance meter (4329A High Resistance Meter manufactured by Yokogawa Hewlett Packard).

The thickness of the resin coating layer of the carrier is preferably adjusted so that the electrical resistance of the carrier will fall in an optimum range. As the thickness of the resin coating layer is increased, the reaction proceeds within the resin coating layer in a less uniform manner since silicone contracts in volume upon condensation reaction. For this reason, the thickness of the resin coating layer is preferably 1.0 μm or less, and more preferably from 0.02 μm to 0.8 μm.

The thickness of the resin coating layer can be measured by observing the cross-section of carrier by transmission electron microscopy (TEM).

-Developer-

The developer of the present invention is a two-component developer containing the above-described carrier of the present invention and a toner.

In such a developer, the toner is preferably mixed with the carrier in an amount of 1.0 part by mass to 10.0 parts by mass with respect to 100 parts by mass of the carrier.

The toner contains at least a binder resin and a coloring agent and, optionally, a releasing agent, a charge-controlling agent and other optional components.

-Toner-

The toner may be produced by any suitable process selected to suit the desired purpose. Examples of such process include a pulverization method, and a chemical method, such as a suspension polymerization method, emulsion polymerization method or polymer suspension method, in which an oil phase is emulsified, suspended or aggregated in an aqueous medium to form toner base particles.

-Binder Resin-

The binder resin may be any known binder resin selected to suit the desired purpose, including homopolymers of styrene or substituted products of styrene, such as polystyrene, poly-p-styrene and polyvinyltoluene; styrene copolymers, such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-methyl-α-chloromethacrylate copolymers, styrene-acrylonitrile copolymers, styrene-vinylmethylether copolymers, styrene-vinyl methyl ketone copolymers, styrene-butadiene copolymers, styrene-isopropyl copolymers and styrene-maleic ester copolymers; polymethylmethacrylate resins; polybutylmethacrylate resins; polyvinyl chloride resins; polyvinyl acetate resins; polyethylene resins; polyester resins; polyurethane resins; epoxy resins; polyvinylbutyral resins; polyacrylic resins; rosin resins; modified rosin resins; terpene resins; phenol resins; aliphatic or aromatic hydrocarbon resins; and aromatic petroleum resins. These binder resins may be used either individually or in combination.

-Coloring Agent-

The coloring agent may be any known dye or pigment selected to suit the desired purpose. Examples include carbon black, nigrosine dye, black iron oxide, naphthol yellow S, hansa yellow (10G, 5G and G), cadmium yellow, yellow iron oxide, loess, chrome yellow, titanium yellow, polyazo yellow, oil yellow, hansa yellow (GR, A, RN and R), pigment yellow L, benzidine yellow (G and GR), permanent yellow (NCG), vulcan fast yellow (5G and R), tartrazine lake, quinoline yellow lake, anthrazane yellow BGL, isoindolinone yellow, red iron oxide, red lead, vermilion lead, cadmium red, cadmium mercury red, antimony vermilion, permanent red 4R, para red, fire red, p-chloro-o-nitroaniline red, lithol fast scarlet G, brilliant fast scarlet, brilliant carmine BS, permanent red (F2R, F4R, FRL, FRLL and F4RH), fast scarlet VD, vulcan fast rubine B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, BON maroon light, BON maroon medium, eosin lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, victoria blue lake, metal-free phthalocyanine blue, phthalocyanine blue, fast sky blue, indanthrene blue (RS and BC), indigo, ultramarine, prussian blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white and lithopone. These coloring agents may be used either individually or in combination.

The coloring agent is preferably added to the toner in an amount of 1% by mass to 15% by mass, and more preferably in an amount of 3% by mass to 10% by mass.

The coloring agent may be combined with a resin to form a masterbatch. Such a resin may be any known resin selected to suit the desired purpose, including polymers of styrene or substituted products thereof, styrene copolymers, polymethyl methacrylate resins, polybuthyl methacrylate resins, polyvinyl chloride resins, polyvinyl acetate resins, polyethylene resins, polypropylene resins, polyester resins, epoxy resins, epoxy polyol resins, polyurethane, polyamide, polyvinyl butyral, polyacrylic resins, rosins, modified rosins, terpene resins, aliphatic hydrocarbon resins, alicyclic hydrocarbon resins, aromatic petroleum resins, chlorinated paraffin and paraffin. These resins may be used either individually or in combination.

-Releasing Agent-

The releasing agent may be any known releasing agent selected to suit the desired purpose, including waxes.

Examples of such waxes include carbonyl group-containing waxes, polyolefin waxes and long-chain hydrocarbons. These waxes may be used either individually or in combination. Of these, carbonyl group-containing waxes are preferred.

Examples of the carbonyl group-containing wax include polyalkanoic acid esters, polyalkanol esters, polyalkanoic acid amides, polyalkyl amides and dialkyl ketones. Examples of the polyalkanoic acid ester include carnauba wax, montan wax, trimethylolpropane tribehenate, pentaerythritol tetrabehenate, pentaerythritol diacetate dibehenate, glycerin tribehenate and 1,18-octadecanediol distearate. Examples of the polyalkanol ester include tristearyl trimellitate, and distearyl maleate. Examples of the polyalkanoic acid amide include dibehenyl amide. Examples of the polyalkyl amide include tristearylamide trimellitate. Examples of the dialkyl ketone include distearyl ketone. Of these carbonyl group-containing waxes, polyalkanoic acid esters are particularly preferred.

Examples of the polyolefin wax include polyethylene waxes and polypropylene waxes.

Examples of the long-chain hydrocarbon include paraffin waxes and Sasol wax.

While the releasing agent may have any melting point suitably selected to suit the desired purpose, it preferably has a melting point in the range of 40° C. to 160° C., more preferably in the range of 50° C. to 120° C., and still more preferably in the range of 60° C. to 90° C. A wax with a melting point of less than 40° C. may adversely affect the heat stability of the toner whereas a wax with a melting point of above 160° C. tends to cause cold offset when the toner is fixed at relatively low temperatures.

The releasing agent may have a melt viscosity in the range of 5 cps to 1,000 cps, and more preferably in the range of 10 cps to 100 cps as measured at a temperature which is 20° C. higher than the melting point of the wax. A releasing agent with a melt viscosity of less than 5 cps may have a decreased releasability, whereas a releasing agent with a melt viscosity of greater than 1,000 cps may fail to achieve anti-hot offset property or improved toner fixation at low temperatures.

While the releasing agent may be added to the toner in any suitable amount selected to suit the desired purpose, it is preferably added in an amount of 1% by mass to 40% by mass, and more preferably in an amount of 3% by mass to 30% by mass.

When the amount of the releasing agent is greater than 40% by mass, the fluidity of the toner may be undesirably decreased.

-Charge-Controlling Agent-

The charge-controlling agent may be any suitable charge-controlling agent. A positive or negative charge-controlling agent may be suitably selected depending on the polarity of the charge stored in the photoconductor.

The negative charge-controlling agent may be a resin or a compound having an electron-donating group, an azo dye or a metal complex of an organic acid. Specific examples include BONTRON (product Nos: S-31, S-32, S-34, S-36, S-37, S-39, S-40, S-44, E-81, E-82, E-84, E-86, E-88, A, 1-A, 2-A, 3-A) (each manufactured by Orient Chemical Industries); KAYACHARGE (product Nos: N-1, N-2); KAYASET BLACK (product Nos: T-2, 004) (each manufactured by Nippon Kayaku); AIZEN SPILON BLACK (T-37, T-77, T-95, TRH, TNS-2) (each manufactured by Hodogaya Chemical); and FCA-1001-N, FCA-1001-NB and FCA-1001-NZ (each manufactured by Fujikura Kasei).

The negative charge-controlling agent may be a basic compound such as nigrosine dye, a cationic compound such as quaternary ammonium salt, or a metal salt of a higher fatty acid. Specific examples include BONTRON (product Nos: N-01, N-02, N-03, N-04, N-05, N-07, N-09, N-10, N-11, N-13, P-51, P-52, AFP-B) (each manufactured by Orient Chemical Industries); TP-302, TP-415 and TP-4040 (each manufactured by HODOGAYA CHEMICAL); COPY BLUE PR and COPY CHARGE (product Nos: PX-VP-435, NX-VP-434) (each manufactured by Hoechst); FCA (product Nos: 201, 201-B-1, 201-B-2, 201-B-3, 201-PB, 201-PZ, 301) (each manufactured by Fujikura Kasei); and PLZ (product Nos: 1001, 2001, 6001, 7001) (each manufactured by Shikoku Chemicals).

These agents may be used either individually or in combination.

While the amount of the charge-controlling agent is determined based on different factors of the toner production method, including the type of the binder resin and dispersion technique employed, and is thus not limited to a particular amount, it is preferred that the charge-controlling agent be added in an amount of 0.1 parts by mass to 10 parts by mass, and more preferably in an amount of 0.2 parts by mass to 5 parts by mass, with respect to 100 parts by mass of the binder resin. The charge-controlling agent when added in amounts greater than 10 parts by mass may make the toner chargeability too high to achieve the desired effect of the charge-controlling agent. As a result, the electrostatic attraction to the development roller is increased, leading to decreased fluidity of the developer or decreased image density. When added in amounts less than 0.1 parts by mass, the charge-controlling agent may fail to provide sufficient charge-rising characteristics and sufficient charge amount, thus affecting the toner image.

In addition to the binder resin, releasing agent, coloring agent and charge-controlling agent, the toner material may also contain other optional components, such as inorganic fine particles, a fluidizing agent, a cleaning-enhancing agent, a magnetic material and a metal soap.

The inorganic particle may be silica, titania, alumina, cerium oxide, strontium titanate, calcium carbonate, magnesium carbonate or calcium phosphate. Silica fine particles hydrophobicized with silicone oil or hexamethyldisilazane and surface-treated titanium oxide are more preferred.

Examples of the silica fine particle include AEROSIL (product Nos: 130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA20OHS, RM50, RY200, REA200) (each manufactured by Nippon Aerosil); HDK (product Nos: H20, H2000, H3004, H2000/4, H2050EP, H2015EP, H3050EP, KHD50) and HVK2150 (each manufactured by Wacker Chemical); and CAB-O-SIL (product Nos: L-90, LM-130, LM-150, M-5, PTG, MS-55, H-5, HS-5, EH-5, LM-150D, M-7D, MS-75D, TS-720, TS-610, TS-530) (each manufactured by Cabot).

The fine particle is preferably added in an amount of 0.1 parts by mass to 5.0 parts by mass, and more preferably in an amount of 0.8 parts by mass to 3.2 parts by mass, with respect to 100 parts by mass of the toner base particles.

The toner may be produced by any suitable technique selected to suit the desired purpose. Among such techniques are a pulverization technique, a polymerization technique (such as suspension polymerization and emulsion polymerization), in which a monomer composition containing a crystalline polymer and a polymerizable monomer is directly polymerized in an aqueous phase, a polyaddition technique, in which a composition containing a crystalline polymer and an isocyanate group-containing prepolymer is directly elongated/crosslinked in an aqueous phase using an amine, another polyaddition technique using an isocyanate group-containing prepolymer, a technique involving dissolving in a solvent, followed by removal of the solvent and pulverization, and a melt spray technique.

The pulverization is a technique in which toner base particles are obtained, for example, by melting or kneading toner materials, followed by pulverization and classification. In the pulverization technique, a mechanical impact may be applied to the resulting toner base particles to control the shape of the particles, or increase the average circularity of the toner particles. This mechanical impact may be applied to the toner base particles by a hybridizer, mechanofusion and other suitable apparatuses.

The above-described toner materials are then mixed and the mixture is melted and kneaded in a melt kneader. The melt kneader used for this purpose may be a single-screw continuous kneader, a twin-screw continuous kneader or a batch kneader using a roll mill. Preferred examples include a twin-screw extruder model KTK manufactured by Kobe Steel, an extruder model TEM manufactured by Toshiba Machine, a twin-screw extruder manufactured by KCK, a twin-screw extruder model PCM manufactured by Ikegai Iron Works and Ko-Kneader manufactured by Buss. Preferably, melting/kneading is carried out under suitable conditions so that the molecular backbones of the binder resin will not be broken. Specifically, the melting/kneading is carried out at a temperature determined based on the softening point of the binder resin. A temperature higher than the softening point will result in excessive breaking of the molecular backbones, whereas too low a temperature may lead to insufficient dispersal.

In the pulverization, the kneaded product is pulverized. In this process, it is preferred that the kneaded product is pulverized first roughly and then finely. To do this, the kneaded product is preferably pulverized by forcing it to hit a plate in a jet stream, by forcing the particles to collide each other in a jet stream, or by pulverizing the product in a narrow gap between a mechanically rotating rotor and a stator.

In the classification, the pulverized product is classified to obtain particles with a predetermined particle size. This can be done, for example, by removing the fine particle fraction by a cyclone, decanter or centrifugation.

After the pulverization and classification, the pulverized product is further classified, for example, by applying a centrifugal force in an air stream, to obtain toner base particles having a predetermined particle size.

In the suspension polymerization, the coloring agent, releasing agent and other necessary components are dispersed in a mixture containing an oil-soluble polymerization initiator and a polymerizable monomer. By using an emulsification technique, the mixture is then emulsified in an aqueous medium containing a surfactant, a solid disperser and other necessary components. The emulsification technique will be further described later. Subsequently, polymerization is carried out to form particles and a wet process is performed to cause the inorganic fine particles to adhere to the surface of the toner base particles. In doing this, it is preferred to rinse the excessive surfactant off the toner base particles and treat the toner base particles.

Examples of the polymerizable monomer include acids, such as acrylic acid, methacrylic acid, α-cyanoacrylic acid, α-cyanomethacrylic acid, itaconic acid, crotonic acid, fumaric acid, maleic acid and maleic anhydride; acrylamide, methacrylamide, diacetoneacrylamide and methylol compounds thereof; vinylpyridine, vinylpyrrolidone, vinylimidazole, ethyleneimine and amino-containing (meth)acrylates, such as dimethylaminoethyl methacrylate. These monomers can be used to introduce functional groups into the surface of the toner base particles.

Since a disperser can be adsorbed and remain on the surface of the particles if it has an acidic or basic group, such a disperser may also be used to introduce functional groups into the surface of the toner base particles.

In the emulsion polymerization, a water-soluble polymerization initiator and a polymerizable monomer are emulsified in water using a surfactant. A common emulsion polymerization process is then carried out to synthesize latex. Meanwhile, the coloring agent and the releasing agent are dispersed in an aqueous medium to form dispersion. The latex is mixed with the dispersion and is allowed to aggregate to toner-sized particles, which are then fused by heating to obtain toner base particles. Subsequently, a wet process involving inorganic particles is performed. This process will be further described later. Functional groups can be introduced into the surface of toner base particles by using latex similar to the monomer used in the suspension polymerization.

Of the different toner base particles, those produced in the following manner are particularly preferred because not only can it have a wide range of usable resins, but it can also be effectively fixed at relatively low temperatures. Furthermore, these toner base particles can be effectively formed into particles and its particle size, size distribution and shape are readily controlled. Specifically, the toner base particles are produced as follows: a toner material containing an active hydrogen-containing compound and a polymer that can react with the active hydrogen-containing compound is dissolved or dispersed in an organic solvent to form a toner solution. The toner solution is then emulsified or dispersed in an aqueous medium to form dispersion. The active hydrogen-containing compound and the polymer reactive with the active hydrogen-containing compound are then reacted in the aqueous medium to form particles of adhesive base material. Finally, the organic solvent is removed to obtain the desired toner base particles.

The toner material contains at least adhesive base material obtained by reacting the active hydrogen-containing compound, the polymer that can react with the active hydrogen-containing compound, the binder resin, the charge-controlling agent and the coloring agent. When necessary, the toner material may further contain other components such as the resin fine particles and the releasing agent.

To improve the flowability of toner and facilitate the storage, development and transfer of the toner, inorganic fine particles, such as hydrophobic silica fine powder, may further be added to and mixed with the toner base particles obtained in the above-described manner. The additive can be mixed using a common powder mixer. However, it is preferred that the mixer is equipped with a jacket to control the internal temperature. To change the load history applied to the additive, the additive may be added either halfway through or gradually. To do this, the RPM, rotation speed, time temperature of the mixer may be varied. A large load may be applied initially, followed by a relatively small load, or vise versa. Examples of the mixer that can be used for this purpose include V-form mixer, rocking mixer, Loedige mixer, Nauta mixer and Henschel mixer. Subsequently, the mixture is passed through a sieve with a mesh size of 250 or larger to remove large particles and aggregated particles. This gives the desired toner.

While the toner for use in the present invention may be of any shape and size that are selected to suit the desired purpose, it preferably has a specific average circularity, volume average particle size, and ratio of volume average particle size to number average particle size (volume average particle size/number average particle size), as described below.

The average circularity is a value obtained by dividing the perimeter of a circle having an area equal to the projected area of a toner particle by the actual perimeter of the same particle. The average circularity of the toner for use in the present invention is preferably in the range of 0.900 to 0.980, and more preferably in the range of 0.950 to 0.975. A preferred toner contains 15% or less of toner particles with an average circularity of less than 0.94.

Toner particles with an average circularity of less than 0.900 may provide neither sufficient transfer efficiency nor dust-free, high-quality images. On the other hand, toner particles with an average circularity of greater than 0.980 may result in incomplete cleaning of a photoconductor and a transfer belt in an imaging system employing blade cleaning. This can cause smeared images. Specifically, toner forming an image on a photoconductor may not be properly transferred from it and may remain on the photoconductor when paper is not fed properly. The toner remaining on the photoconductor can cause background depositions in the resulting images. This occurs especially in images of a large imaging area such as photographs. Furthermore, the remaining toner may contaminate a charging roller that contacts and charges the photoconductor. As a result, the charging roller may lose original charging performance.

The average circularity was measured by a flow-type particle image analyzer (FPIA-2100 manufactured by Sysmex) and analyzed by a software (FPIA-2100 Data Processing Program for FPIA version 00-10). Specifically, 0.1 ml to 0.5 ml of 10% by mass surfactant (alkylbenzene sulfonate, NEOGEN SC-A, manufactured by Dai-ichi Kogyo Seiyaku) was placed in a 100 ml glass beaker. 0.1 g to 0.5 g of each toner was added and the mixture was stirred with a microspatula, followed by the addition of 80 ml of ion exchange water. The resulting dispersion was sonicated with an ultrasonic disperser (Honda Electronics) for 3 min. Using FPIA-2100, the dispersion was then analyzed for the shape and the size distribution of toner to a toner concentration of 5,000 particles/μl to 15,000 particles/μl. In this method, it is important to adjust the concentration of the dispersion to a range of 5,000 particles/μl to 15,000 particles/μl to ensure reproducibility of the measurement of average circularity. To achieve this concentration, conditions of the dispersion (i.e, amounts of surfactant and toner added) need to be varied. As is the case with the above-described measurement of the toner particle size, the required amount of the surfactant varies depending on the hydrophobicity of the toner: too much of the surfactant may cause noise due to foaming, whereas too little of it may result in insufficient wetting of toner and, thus, insufficient toner dispersal. The amount of the toner varies depending on its particle size: a toner with a smaller particle size needs to be added in a smaller amount, whereas a toner with a larger particle size needs to be added in a larger amount. Specifically, for a toner with a particle size of 3 μm to 10 μm, the toner concentration of a dispersion can be adjusted to a range of 5,000 particles/μl to 15,000 particles/μl by adding 0.1 g to 0.5 g of the toner.

While the toner may have any volume average particle size that is selected to suit the desired purpose, it preferably has a volume average particle size in the range of 3 μm to 10 μm, and more preferably in the range of 3 μm to 8 μm.

When a toner with a volume average particle size of less than 3 μm is used in a two-component developer, the toner may fuse to a surface of a carrier during the long stirring period in a development unit. As a result, the charge performance of the carrier may be decreased. On the other hand, a toner with a volume average particle size of greater than 10 μm may make it difficult to achieve high resolution, high quality images. Moreover, the variation in the toner particle size may become significant when the toner in the developer is replaced.

In the toner for use in the present invention, the ratio of a volume average particle size to a number average particle size (volume average particle size/number average particle size) is preferably in the range of 1.00 to 1.25, and more preferably in the range of 1.10 to 1.25.

The volume average particle size of the toner, as well as the ratio of the volume average particle size to the number average particle size (volume average particle size/number average particle size) of the toner, was measured by using a particle size analyzer (Multisizer III manufactured by Beckman Coulter) at an aperture size of 100 μm and the results were analyzed by a software (Beckman Coulter Multisizer 3 Version 3.51). Specifically, 0.5 ml of 10% by mass surfactant (alkylbenzene sulfonate, NEOGEN SC-A, manufactured by Dai-ichi Kogyo Seiyaku) was placed in a 100 ml glass beaker. 0.5 g of each toner was added and the mixture was stirred with a microspatula, followed by the addition of 80 ml of ion exchange water. The resulting dispersion was sonicated with an ultrasonic disperser (W-113MK-II manufactured by Honda Electronics) for 10 min. Subsequently, the dispersion was analyzed on Multisizer III using Isoton III (manufactured by Beckman Coulter) as a measurement solution. During the measurement, the toner sample dispersion was added dropwise to adjust the concentration reading of the apparatus to 8±2%. In this method, it is important to adjust the concentration to 8±2% to ensure reproducibility of the measurement of particle size. No significant error occurs in the particle size within this concentration range.

The toner may be colored to any color that is selected to suit the desired purpose. For example, the toner may be colored to at least one color selected from black toner, cyan toner, magenta toner and yellow toner. While each toner color may be obtained by properly selecting the type of the coloring agent, each color is preferably given by a color toner.

-Developer Container-

The developer container contains a container and the developer of the present invention disposed therein.

The container may be any known container including one having a container body and a cap.

The container body may be of any size, shape, structure or material that is selected to suit the desired purpose. A preferred shape is a cylinder that has a spiral feature formed on the inner surface thereof, so that when the container body is rotated, the developer contained in it is moved toward the outlet. Part of or whole spiral feature may be formed as a bellows.

While the container body may be formed of any material, it is preferably formed of a material that can achieve high dimensional accuracy, such as resins. Among preferred resins are polyester resins, polyethylene resins, polypropylene resins, polystyrene resins, polyvinylchloride resins, polyacrylic acid, polycarbonate resins, ABS resins and polyacetal resins.

Such a developer container is suitable for storage and transportation and is readily handleable; it can be detachably attached to a process cartridge or image forming apparatus to supply the developer. The process cartridge will be further described below.

-Process Cartridge-

The process cartridge for use in the present invention includes at least a latent electrostatic image-bearing member on which a latent electrostatic image is formed and a development unit configured to develop the latent electrostatic image formed on the latent electrostatic image-bearing member using the developer of the present invention so as to a visible image. If necessary, the process cartridge may further include other optional units.

The development unit includes at least the developer container containing the developer of the present invention and the developer-bearing member that receives and transports the developer contained in the developer container. If necessary, the development unit may further include a layer thickness controlling member configured to control the thickness of the toner layer formed and borne on the developer-bearing member.

The process cartridge can be removably mounted on various electrophotographic image forming apparatuses. It is preferably mounted on an image forming apparatus for use in an image forming method of the present invention, which will be described later.

Figure 2:
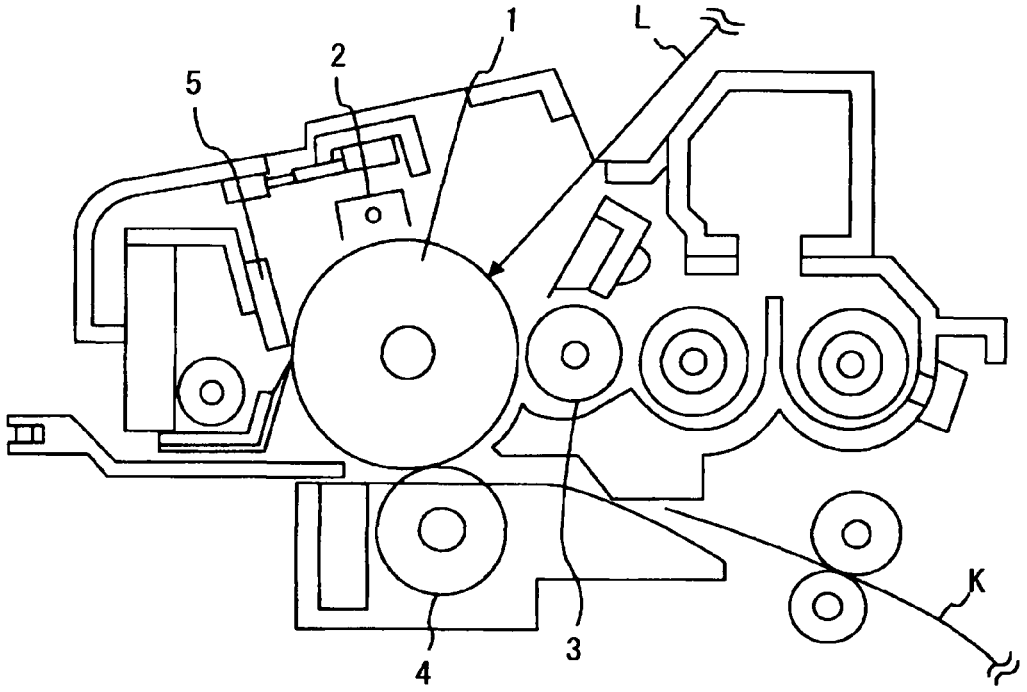
FIG. 2 is an illustrative diagram of an exemplary process cartridge for use in an image forming method of the present invention.

As shown in FIG. 2, an exemplary process cartridge contains a photoconductor 1 as the latent electrostatic image-bearing member, and further contains a charging unit 2, a development unit 3, a transfer unit 4 and a cleaning unit 5. If necessary, the process cartridge may further include other members. An exposure light beam L emitted by an exposure unit (not shown) is transmitted onto the photoconductor 1. The light source used can write at high resolution. In the figure, reference numeral 6 denotes recording medium.

According to the imaging process implemented by the process cartridge shown in FIG. 2, as the photoconductor 1 rotates in the direction indicated by an arrow, it is charged by the charging unit 2 and exposed by the exposure unit (not shown) to form a latent electrostatic image on its surface that corresponds to the exposed image. This latent electrostatic image is developed with the toner by the development unit 3 so as to form a toner image, which in turn is transferred by the transfer unit 4 onto the recording medium K for print-out. After image-transfer, the surface of the photoconductor is cleaned by the cleaning unit 5 and discharged by a discharging unit (not shown). These procedures are repeated.

(Image Forming Method and Image Forming Apparatus)

An image forming method of the present invention includes at least a latent electrostatic image-forming step, a development step, a transfer step and a fixing step, and, if necessary, other optional steps such as a discharging step, a cleaning step, a recycling step and a control step.

An image forming apparatus for use in the present invention includes at least a latent electrostatic image-bearing member, a latent electrostatic image-forming unit, a development unit, a transfer unit and a fixing unit, and, if necessary, other optional units such as a discharging unit, a cleaning unit, a recycling unit and a control unit.

<Latent Electrostatic Image-Forming Step>

The latent electrostatic image forming step is forming a latent electrostatic image on a latent electrostatic image-bearing member.

While the latent electrostatic image-bearing member (referred to also as "photoconductor") may be of any known material, shape, structure or size, it preferably has a drum-like shape and is preferably made of an inorganic photoconductor, such as amorphous silicon and selenium, or an organic photoconductor (OPC), such as polysilane and phthalopolymethine. Of these materials, amorphous silicon is preferred because of its long life.

A latent electrostatic image can be formed, for example, by uniformly charging the surface of the latent electrostatic image-bearing member, and subsequently exposing the surface to form an image. This can be done by the latent electrostatic image-forming unit. The latent electrostatic image-forming unit includes at least a charger configured to uniformly charge the surface of the latent electrostatic image-bearing member and an exposing unit configured to expose the surface of the latent electrostatic image-bearing member imagewise so as to form a latent electrostatic image.

The charging can be carried out, for example, by applying a voltage to the surface of the latent electrostatic image-bearing member using the charger.

The charger may be any charger that is selected to suit the desired purpose. Examples include a known contact charger having a conductive or semiconductive roll, brush, film or rubber blade, and a non-contact charger that utilizes corona discharge, such as corotron and scorotron.

The charger may or may not be arranged in contact with the latent electrostatic image-bearing member and preferably charges the surface of the latent electrostatic image-bearing member by simultaneously applying DC and AC voltages.

The charger may be a charging roller arranged in close proximity to, but not in contact with, the latent electrostatic image-bearing member with an intervening strip of gap tape. The charging roller preferably charges the surface of the latent electrostatic image-bearing member by simultaneously applying DC and AC voltages to the charging roller.

The exposure may be carried out, for example, by exposing the surface of the latent electrostatic image-bearing member imagewise by means of the exposing unit so as to form a latent electrostatic image.

Any exposing unit may be used as long as it can expose the surface of the latent electrostatic image-bearing member imagewise corresponding to a desired image and such an exposing unit may be selected to suit the desired purpose. Examples of such exposing unit include a photocopier optical system, rod lens array system, laser optical system, liquid crystal shutter optical system and various other exposing units.

A backlight system that exposes the latent electrostatic image-bearing member imagewise from the backside may also be used in the present invention.

<Development Step and Development Unit>

The developing step is developing the latent electrostatic image using the developer of the present invention so as to form a visible image.

The formation of visible image can be carried out, for example, by developing the latent electrostatic image with the developer of the present invention. This can be done by the development unit.

Any known development unit may be used as long as it uses the developer of the present invention to develop the latent electrostatic image. A preferred development unit includes at least a development device that contains the developer of the present invention and that can apply the developer to the latent electrostatic image in a manner that may or may not involve the contact of the developer with the latent electrostatic image-bearing member. A more preferred development unit includes a development device having the above-described development container.

The development device may be of a dry-development or a wet-development, or it may be a monocolor development device or a multicolor development device. A preferred development device includes a stirrer for stirring the developer (to cause the developer particles to rub against each other and charge) and a rotatable magnet roller.

In the development device, for example, the toner and the carrier are mixed and stirred together. As the toner particles and carrier particles are rubbed against each other, the toner particles are charged and held in a standing state on the surface of the magnet roller, forming a magnetic brush. Since the magnetic roller is arranged in close proximity to the latent electrostatic image-bearing member (i.e., the photoconductor), electrical attraction causes some of the toner particles forming the magnetic brush on the surface of the magnetic roller to move to the surface of the latent electrostatic image-bearing member (i.e. the photoconductor). As a result, the latent electrostatic image is developed by the toner to form a visible toner image on the surface of the latent electrostatic image-bearing member (i.e., the photoconductor).

The developer to be contained in the developer device is the developer of the present invention.

<Transfer Step and Transfer Unit>

The transfer step is transferring the visible image to the recording medium. In a preferred embodiment, the visible image is transferred first to an intermediate transfer member (primary transfer) and then to the recording medium (secondary transfer). A more preferred embodiment involves a primary transfer step in which a visible image is transferred to an intermediate transfer member in such a manner to form a composite transfer image formed of two or more color toners, preferably of full color toners, and a secondary transfer step in which the composite transfer image is transferred to the recording medium.

The transfer can be carried out, for example, by charging the visible image on the latent electrostatic image-bearing member (i.e., the photoconductor) using a transfer charger. This can be done by the transfer unit. A preferred embodiment of the transfer unit includes a primary transfer unit configured to transfer a visible image to an intermediate transfer member to form a composite transfer image, and a secondary transfer unit configured to transfer the composite transfer image to the recording medium.

The intermediate transfer medium may be any known transfer medium that is selected to suit the desired purpose. Examples include a transfer belt.

The transfer unit (primary and secondary transfer units) preferably includes at least a transferer configured to charge the visible image formed on the latent electrostatic image-bearing member (i.e., the photoconductor) so that the visible image leaves the latent electrostatic image-bearing member and is transferred to the recording medium. One or more transfer units may be used.

The transferer may be a corona transferer utilizing corona discharge, a transfer belt, a transfer roller, a pressure transfer roller or an adhesion transfer roller.

The recording medium may be any known recording medium (recording paper).

<Fixing Step and Fixing Unit>

The fixing step is fixing the transferred visible image to the recording medium by means of a fixing unit. The fixing may be performed each time when each of the multiple color developers is transferred, or once after all of the multiple color developers are transferred and superimposed.

While the fixing unit may be any fixing device that is selected to suit the desired purpose, a known heating and press unit is preferred. The heating and press unit may be a combination of heating belt and press roller or a combination of heat belt, press roller and endless belt.

The fixing device preferably includes a heater having a heating element, a film arranged in contact with the heater, and a press member pressed against the heater with the film arranged in between. In use, a recording medium with an unfixed image formed thereon is passed between the film and the press member and heated to fix the image on the medium. The heating and press unit typically heats at a temperature of 80° C. to 200° C.

In the present invention, a known photofixing device may be used in addition to or as an alternative to the above-described fixing step and fixing unit.

<Discharging Step>

The discharging step is applying discharge bias voltage to the latent electrostatic image-bearing member so as to discharge the latent electrostatic image-bearing member. This can be done by the discharging unit.

The discharging unit may be any known discharger that can apply a discharge bias voltage to the latent electrostatic image-bearing member. Examples include a discharging lamp.

<Cleaning Step>

The cleaning step is removing any remaining toner on the latent electrostatic image-bearing member. This can be done by the cleaning unit.

The cleaning unit may be any known clearing unit that can remove toner remaining on the latent electrostatic image-bearing member. Preferred examples include magnetic brush cleaner, electrostatic brush cleaner, magnetic roller cleaner, blade cleaner, brush cleaner and web cleaner.

<Recycling Step>

The recycling step is recycling the removed toner in the cleaning step to the development unit. This can be done by the recycling unit.

The recycling unit may be any recycling unit, including known conveyor units.

<Control Step>

The control step is controlling each of the above-described steps. This can be done by the control unit.

The control unit can be any control unit that can control operation of each of the above-described unit and is selected to suit the desired purpose. Examples include sequencers, computers and other instruments.

Figure 3:
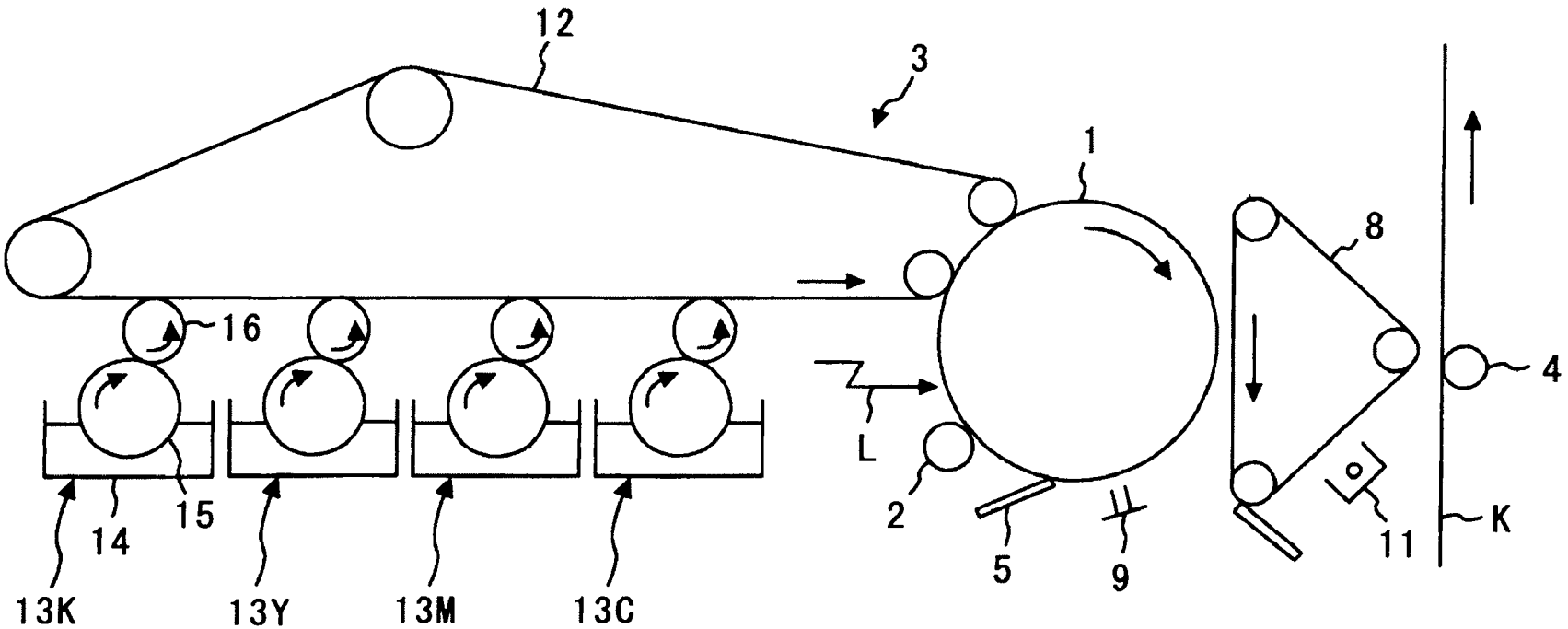
FIG. 3 is an illustrative diagram of an exemplary development unit of an image forming apparatus to implement the image forming method of the present invention.

Referring now to FIG. 3, one embodiment of the image forming method of the present invention implemented by the image forming apparatus is described. An image forming apparatus shown in FIG. 3 includes a photoconductor 1, a charging unit (charging roller) 2, an exposure unit that emits an exposure light beam L, a development unit (development assembly) 3, an intermediate transfer member 8, a cleaning unit (cleaning device) 5 having a cleaning blade, and a discharging lamp 9 to serve as the discharging unit.

The intermediate transfer member 8 is an endless belt designed to be moved in the direction of arrow by three internally arranged rollers that support the belt. Some of the three rollers may also serve as a transfer bias roller that can apply a transfer bias voltage (primary transfer bias voltage) to the intermediate transfer member 8. An intermediate transfer member-cleaning blade 10 is arranged adjacent to the intermediate transfer member 8. A transfer unit (transfer roller) 4 that can apply a transfer bias voltage for transferring a visible image (toner image) to a recording medium K (secondary transfer) is arranged opposite the intermediate transfer member 8. A corona charger 11 for applying a charge to the visible image on the intermediate transfer member 8 is arranged near the intermediate transfer member 8 between the contact area of the photoconductor 1 with the intermediate transfer member 8 and the contact area of the intermediate transfer member 8 with the recording medium K, as viewed in the direction of the movement of the intermediate transfer member 8.

The development assembly 3 includes a development belt 12 to serve as the developer-bearing member and development units 13K, 13Y, 13M and 13C arranged along the development belt 12. The development units 13K, 13Y, 13M and 13C each include a developer container 14, a developer feed roller 15 and a development roller 16. The development belt 12 is an endless belt that is movably supported by a plurality of belt rollers and is partly in contact with the photoconductor 1.

In the image forming apparatus shown in FIG. 3, the charging roller 2 uniformly charges the photoconductor 1. An exposure device exposes the photoconductor to form a latent electrostatic image on the photoconductor. The latent electrostatic image formed on the photoconductor is developed by toners fed from the development assembly 3 to form a visible image (toner image). The visible image (toner image) is first transferred to the intermediate transfer member 8 (primary transfer) and subsequently to the recording medium K (secondary transfer). As a result, the recording medium K has a transferred image on it. The remaining toner on the photoconductor 1 is removed by the cleaning device 5 and the photoconductor 1 is discharged by the discharging lamp 9.

Figure 4:
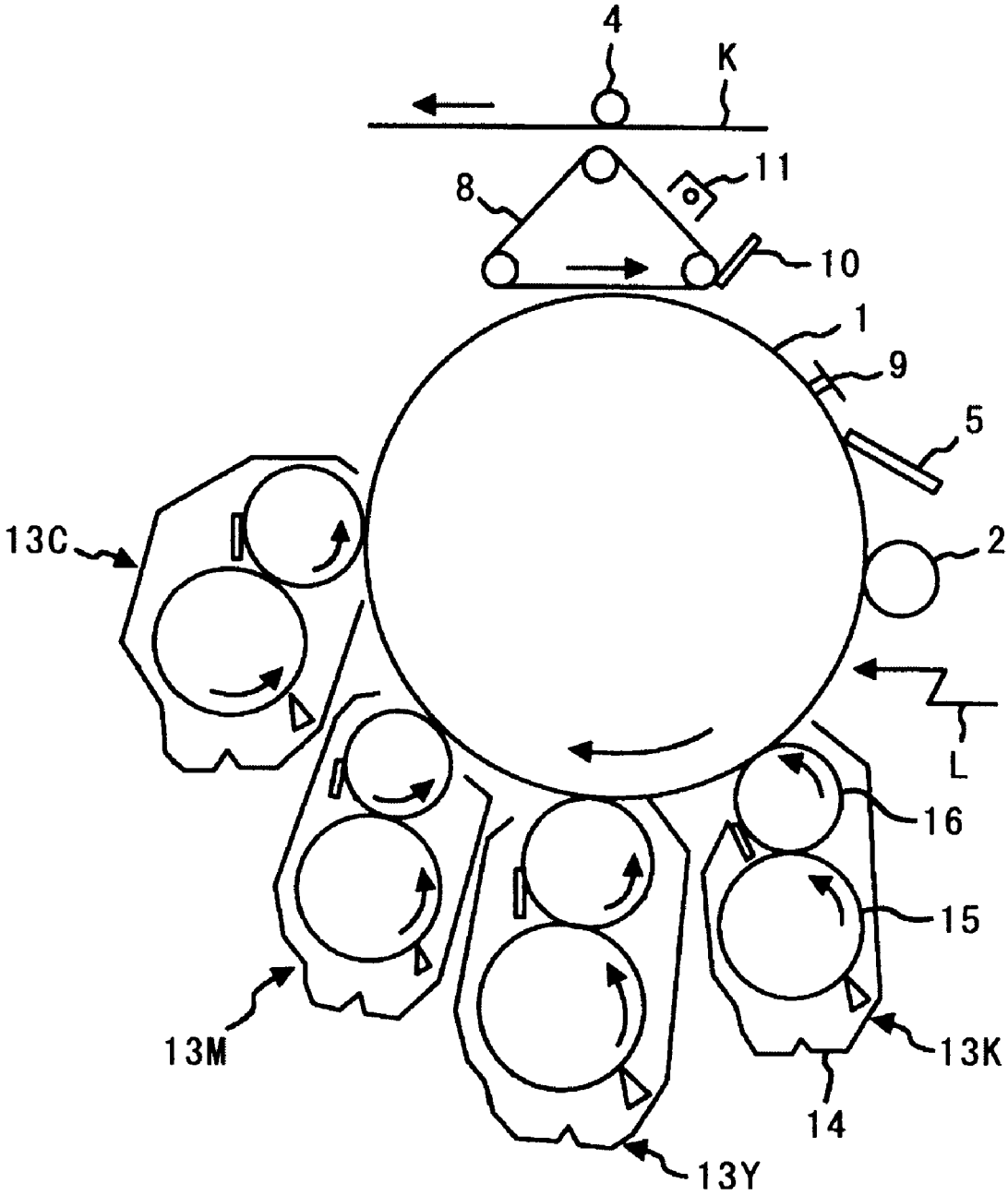
FIG. 4 is an illustrative diagram of another development unit of the image forming apparatus to implement the image forming method of the present invention.

Referring now to FIG. 4, another embodiment of the image forming method of the present invention implemented by the image forming apparatus is now described. An image forming apparatus shown in FIG. 4 has essentially the same construction and provides essentially the same effect as the image forming apparatus shown in FIG. 3, except that the development belt 12 is not provided and development units 13K, 13Y, 13M and 13C are arranged directly around the photoconductor 1. In FIG. 4, the same numerals as those used in FIG. 3 denote the same elements as those depicted in FIG. 3.

In the image forming apparatus shown in FIG. 4, a discharging lamp 9 transmits light onto a photoconductor 1 so as to discharge the photoconductor. The remaining toner on the surface of the photoconductor 1 is removed by a cleaning device 5. Subsequently, a charging roller 2 uniformly charges the surface of the photoconductor 1 to a uniform potential. An exposure light beam L containing an optical image is then transmitted onto the photoconductor 1. Toners of different colors are applied to the photoconductor 1 from development units 13K, 13Y, 13M and 13C to develop the latent electrostatic image into a visible image, which in turn is transferred to an intermediate transfer member 8 and then to recording medium K.

Figure 5:
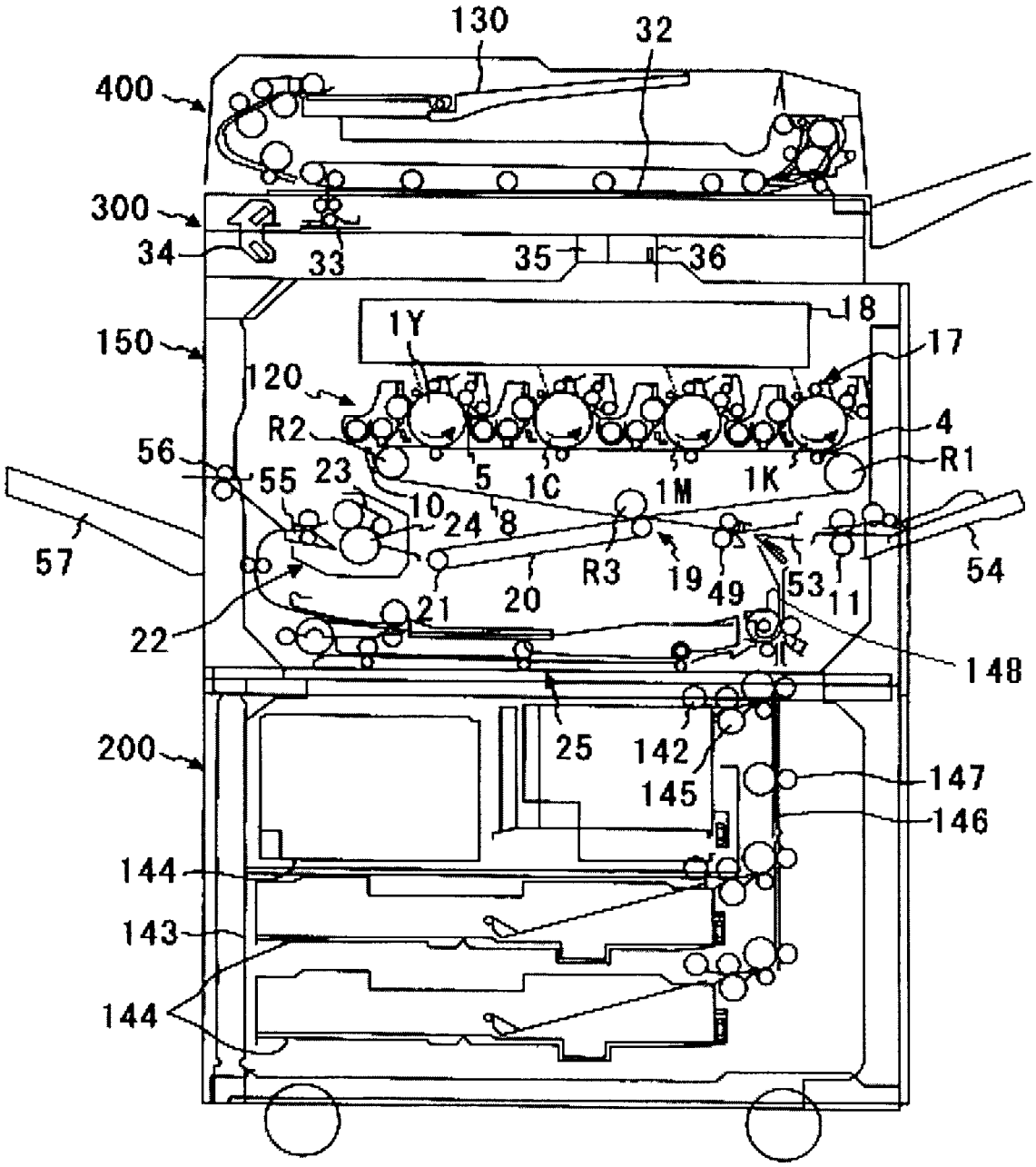
FIG. 5 is an illustrative diagram of one embodiment of the image forming apparatus to implement the image forming method of the present invention.

Referring now to FIG. 5, another embodiment of the image forming method of the present invention implemented by the image forming apparatus is now described. The image forming apparatus shown in FIG. 5 is a tandem color image forming apparatus. The tandem color image forming apparatus includes a copier body 150, a paper feed table 200, a scanner 300 and an automatic document feeder (ADF) 400.

Arranged at the center of the copier body 150 is an intermediate transfer member 8 in the form of endless belt. Support rollers R1, R2 and R3 support the intermediate transfer member 8 while allowing the intermediate transfer member 8 to move in the counterclockwise direction. An intermediate transfer member-cleaning blade 10 for removing toner remaining on the intermediate transfer member 8 is arranged adjacent to the support roller R2. A tandem development assembly 120 having four imaging units 17 (yellow, cyan, magenta and black) arranged in tandem is arranged with the four imaging units 17 facing the portion of the intermediate transfer member 8 between the support roller R1 and the support roller R2 and arranged along the direction of movement of the intermediate transfer member 8. An exposure device 18 is arranged adjacent to the tandem development assembly 120. Arranged on the side of the intermediate transfer member 8 opposite to the tandem development assembly 120 is a secondary transfer device 19, which includes a secondary transfer endless belt 20 supported by a pair of rollers 21. The secondary transfer device 19 allows transfer paper (i.e., a recording medium) conveyed on the secondary transfer belt 20 to come into contact with the intermediate transfer member 8. Arranged adjacent to the secondary transfer device 19 is a fixing device 22 that includes a fixing endless belt 23 and a press roller 24 pressed against the fixing belt 23.

The tandem image forming apparatus also includes a sheet turnover device 25 in the vicinity of the secondary transfer device 19 and the fixing device 22 for turning over transfer paper so that images can be formed on each side of the transfer paper (i.e., the recording medium).

How a full color image (color copy) can be formed by the tandem development assembly 120 will now be described. Specifically, a document to be copied is placed on a document table 130 of the automatic document feeder (ADF) 400, or the ADF 400 may be opened, the document is then placed on a contact glass 32 of the scanner 300 and the ADF 400 is closed again.

When the user presses the start switch (not shown) and if the document is placed on the ADF 400, the document is first sent to and positioned above the contact glass 32 before the scanner 300 is activated, or the scanner 300 is immediately activated if the document is placed on the contact glass 32. As the scanner 300 is activated, a first traveler 33 starts to travel, followed by a second traveler 34. The first traveler 33 directs light from the light source to the document. Light reflected by the document surface is reflected by a mirror mounted on the second traveler 34 and travels through an imaging lens 35 into a read sensor 36, where the color document (color image) is read and resolved into black, yellow, magenta and cyan image data.

Figure 6:
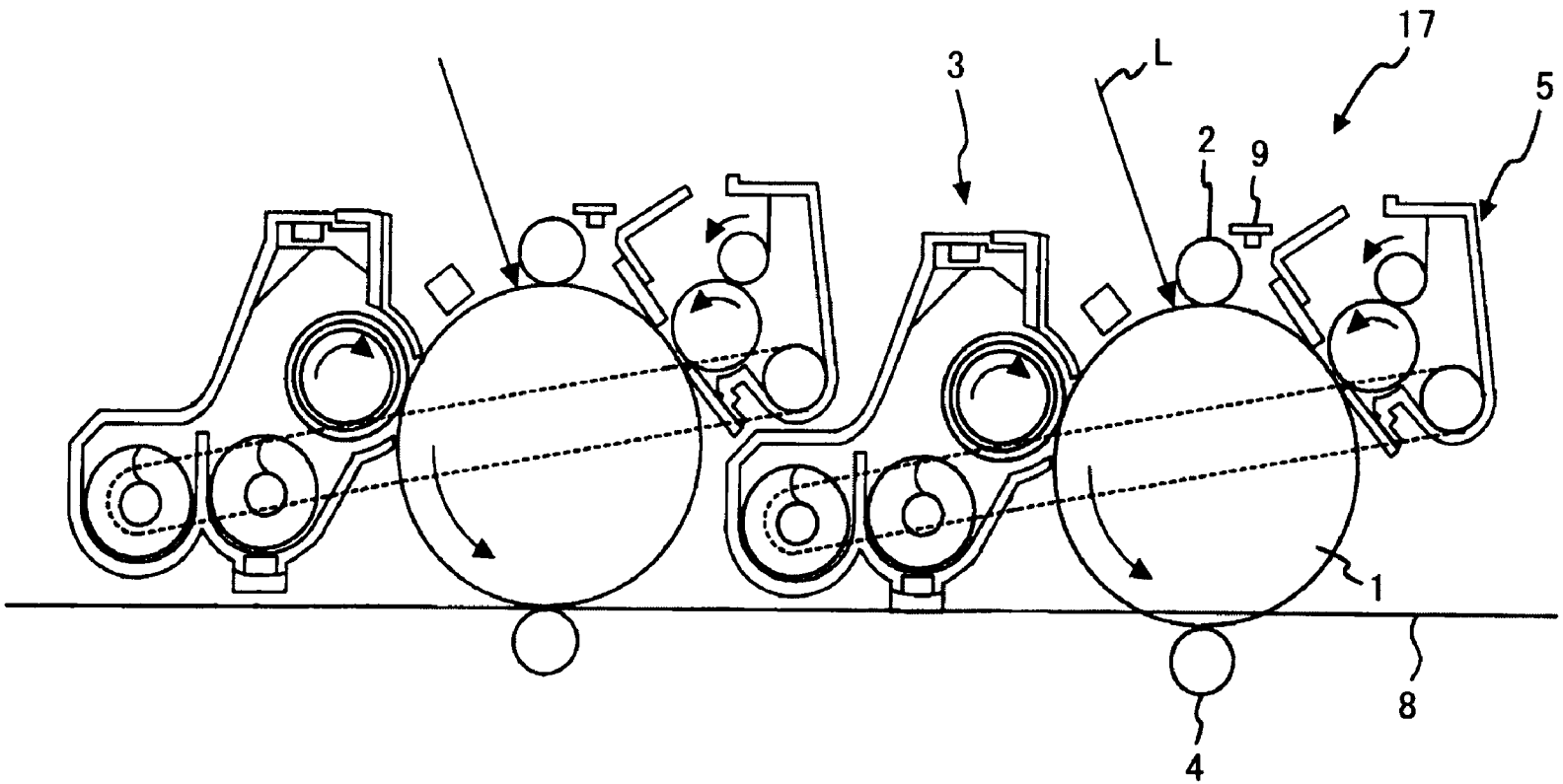
FIG. 6 is an illustrative diagram of a development unit of the image forming apparatus of FIG. 5.

The black, yellow, magenta and cyan image data are sent to the respective imaging units 17 (i.e., black imaging unit, yellow imaging unit, magenta imaging unit and cyan imaging unit) of the tandem development assembly 120, where black, yellow, magenta and cyan toner images are formed, respectively. Specifically, as shown in FIG. 6, the imaging units 17 (i.e., black imaging unit, yellow imaging unit, magenta imaging unit and cyan imaging unit) of the tandem development assembly 120 each include a photoconductor 1, a charging roller 2 for uniformly charging the photoconductor 1, an exposure device for exposing the photoconductor 1 with an exposure light beam L based on each color data to form a latent electrostatic image corresponding to each color image on the photoconductor 1, a development device 3 for developing the latent electrostatic image with one of the color toners (i.e., black toner, yellow toner, magenta toner and cyan toner) to form a toner image of each color toner; a transfer roller 4 for transferring the toner image to an intermediate transfer member 8, a cleaning device 5 and a discharging lamp 9. In this manner, each imaging unit 17 can form a monochromic image (i.e., black image, yellow image, magenta image or cyan image) based on each color data.

The black image formed on the photoconductor 1K for black, the yellow image formed on the photoconductor 1Y for yellow, the magenta image formed on the photoconductor 1M for magenta and the cyan image formed on the photoconductor 1C for cyan are then sequentially transferred to the intermediate transfer member 8 moved by the support rollers R1, R2 and R3 (primary transfer), resulting in a superimposed composite color image (color transfer image) of the black, yellow, magenta and cyan images formed on the intermediate transfer member 8.

In the paper feed table 200, one of paper feed roller 142 is selectively activated to advance a stack of recording paper sheets from one of paper feed cassettes 144 that are stacked in a paper bank 143. A separator roller 145 separates a single sheet of paper and sends it out to a paper feed path 146, from where the sheet is advanced by a conveyor roller 147 on a paper feed path 148 into the copier body 150 where it hits a resist roller 49 and comes to a stop. Alternatively, a stack of recording paper placed on a hand feed tray 54 are advanced by the paper feed roller 142 and the separator roller 145 separates a single sheet from the stack and sends it out on a hand feed paper path 53, on which the paper sheet advances until it hits the resist roller 49 and comes to a stop. While the resist roller 49 is typically grounded when in use, a bias voltage may be applied to the roller to remove paper powder from the sheet. The resist roller 49 is then rotated in timing with the composite color image (color transfer image) formed on the intermediate transfer member 8 to send out the sheet (recording paper) between the intermediate transfer member 8 and the secondary transfer device 19 where the composite color image (color transfer image) is transferred to the sheet (recording paper) by the secondary transfer device 19 to form a color image on the sheet (recording paper). The toner remaining on the intermediate transfer member 8 after the image has been transferred from it is removed by the intermediate transfer member cleaning blade 10.

The sheet (recording paper) having the color image transferred to it is then conveyed by the secondary transfer device 19 into the fixing device 22 where heat and pressure are applied to the sheet (recording paper) to fix the composite color image (color transfer image) to the sheet. Subsequently, the sheet (recording paper) is switched in direction by a switch claw 55 and discharged by a discharge roller 56 out into a discharge tray 57 where it is stacked. Alternatively, after switched in direction by the switch claw 55, the sheet (recording paper) is turned over by the sheet turnover device 25 and guided back into the transfer position where an image is recorded on the backside. The sheet is then discharged by the discharge roller 56 into the discharge tray 57 and stacked.

The image forming method described above with reference to one embodiment uses the carrier of the present invention, which not only has high mechanical strength, but also causes no toner scattering or background depositions. The method, therefore, can efficiently form high quality images.

EXAMPLES

The present invention will now be described with reference to examples, which are not intended to limit the scope of the invention in any way.

Production Example 1

-Preparation of Toner 1-

100 parts by mass of a polyester resin (weight–average molecular weight=12,000), 2 parts by mass of a copper phthalocyanine pigment and 2 parts by mass of a charge-controlling agent represented by Structural Formula 1 (iodine salt of nonylene perfluoroether-p-trimethylaminopropyl amidophenyl) were kneaded together at 120° C. by a heat roll. The mixture was cooled to solidify and the solid product was pulverized and classified to obtain toner base particles having a volume-average particle size of 7.1 μm, a number-average particle size of 5.8 μm and an average circularity of 0.953.

Structural Formula 1

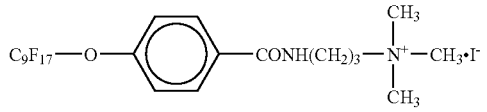

To 100 parts by mass of the resulting toner base particles, 0.5 parts by mass of silica R972 (manufactured by Nippon Aerosil) were added and the mixture was mixed to give Toner 1.

Production Example 2

-Preparation of Toner 2-

100 parts by mass of a polyester resin (weight–average molecular weight: 12,000), 5 parts by mass of carbon black and 2 parts by mass of a chromium-containing azo dye represented by Structural Formula 2 were kneaded together at 120° C. by a heat roll. The mixture was cooled to solidify and the solid product was pulverized and classified to obtain toner base particles having a volume-average particle size of 7.3 μm, a number-average particle size of 6.0 μm and an average circularity of 0.955.

Structural Formula 2

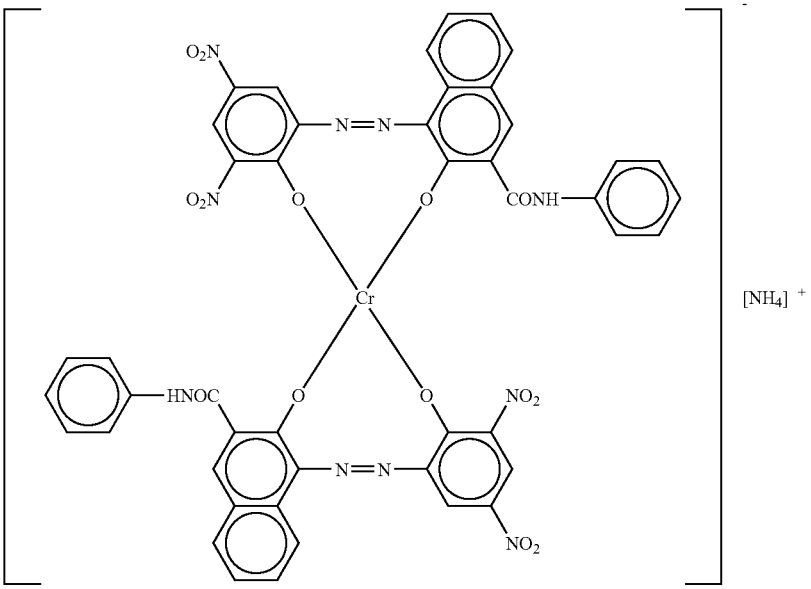

To 100 parts by mass of the resulting toner base particles, 0.5 parts by mass of silica R972 (manufactured by Nippon Aerosil) were added and the mixture was mixed to give Toner 2.

Production Example 3

<Preparation of Toner 3>

-Synthesis of Organic Fine Particle Emulsion-

To a reaction vessel equipped with a stir bar and a thermometer, 683 parts by mass of water, 11 parts by mass of sodium salt of sulfuric ester of methacrylic acid ethylene oxide adduct (ELEMINOL RS-30 manufactured by Sanyo Chemical Industries), 83 parts by mass of styrene, 83 parts by mass of methacrylic acid, 110 parts by mass of butyl acrylate and 1 part by mass of ammonium persulfate were added and the mixture was stirred at 400 rpm for 15 min to obtain a white emulsion. This emulsion was heated to an internal temperature of 75° C. and the reaction was allowed to proceed for 5 hours. Subsequently, 30 parts by mass of a 1% by mass aqueous ammonium persulfate solution were added and the mixture was aged at 75° C. for 5 hours to give an aqueous dispersion of a vinyl resin (methacrylic acid-butyl acrylate-sodium salt of sulfuric ester of methacrylic acid ethylene oxide adduct). This aqueous dispersion was designated as Fine Particle Dispersion 1.

The volume-average particle size of the fine particles present in Fine Particle Dispersion 1 was measured by a laser scattering particle size distribution analyzer (LA-920 manufactured by Horiba) and was determined to be 105 nm. In addition, some of Fine Particle Dispersion 1 was dried and the resin component was isolated. This resin component was determined to have a glass transition temperature (Tg) of 59° C. and a weight–average molecular weight (Mw) of 150,000.

-Preparation of Aqueous Phase- 990 parts by mass of water, 83 parts by mass of Fine Particle Dispersion 1, 37 parts by mass of a 48.5% by mass aqueous solution of sodium dodecyl diphenyl ether disulfonate (ELEMINOL MON-7 manufactured by Sanyo Chemical Industries) and 90 parts by mass of ethyl acetate were mixed and stirred together to form a milky white liquid. This liquid was designated as Aqueous Phase 1.

-Synthesis of Low-Molecular-Weight Ester-

To a reaction vessel equipped with a cooling tube, a stirrer and a tube for introducing nitrogen, 229 parts by mass of an adduct of 2 mol ethylene oxide to bisphenol A, 529 parts by mass of an adduct of 3 mol propylene oxide to bisphenol A, 208 parts by mass of terephthalic acid, 46 parts by mass of adipic acid and 2 parts by mass of dibutyltin oxide were added and the reaction was carried out at 230° C. under atmospheric pressure for 8 hours. Subsequently, the reaction was farther carried out under a reduced pressure of 10 mmHg to 15 mmHg for 5 hours. 44 parts by mass of trimellitic anhydride were then added to the reaction vessel and the reaction was carried out at 180° C. under atmospheric pressure for 2 hours to synthesize Low-Molecular-Weight Polyester 1.

Low-Molecular-Weight Polyester 1 was determined to have a glass-transition temperature (Tg) of 45° C., a weight–average molecular weight (Mw) of 5,800, a number-average molecular weight of 2,600 and an acid value of 24 mg KOH/g.

-Synthesis of Polyester Prepolymer-

To a reaction vessel equipped with a cooling tube, a stirrer and a tube for introducing nitrogen, 682 parts by mass of an adduct of 2 mol ethylene oxide to bisphenol A, 81 parts by mass of an adduct of 2 mol propylene oxide to bisphenol A, 283 parts by mass of terephthalic acid, 22 parts by mass of trimellitic anhydride and 2 parts by mass of dibutyltin oxide were added and the reaction was carried out at 230° C. under atmospheric pressure for 8 hours. Subsequently, the reaction was further carried out under a reduced pressure of 10 mmHg to 15 mmHg for 5 hours to synthesize Intermediate Polyester 1.

Intermediate Polyester 1 was determined to have a number-average molecular weight of 2,100, a weight–average molecular weight of 9,500, a glass transition temperature (Tg) of 55° C., an acid value of 0.5 mg KOH/g and a hydroxyl value of 51 mg KOH/g.

410 parts by mass of Intermediate Polyester 1, 89 parts by mass of isophorone diisocyanate and 500 parts by mass of ethyl acetate were added to a reaction vessel equipped with a cooling tube, a stirrer, and a tube for introducing nitrogen. The reaction was carried out at 100° C. for 5 hours to obtain Prepolymer 1.

Prepolymer 1 was determined to have a free isocyanate content of 1.74% by mass.

-Synthesis of Ketimine-

To a reaction vessel equipped with a stirring bar and a thermometer, 170 parts by mass of isophorone diamine and 75 parts by mass of methyl ethyl ketone were added and the reaction was carried out at 50° C. for 5 hours to synthesize Ketimine Compound 1. Ketimine Compound 1 was determined to have an amine value of 418.

-Preparation of Master Batch (MB)-

1,200 parts by mass of water, 540 parts by mass of carbon black (PBk-7: Printex 60, manufactured by Degussa, DBP oil absorbance=114 ml/100 mg, pH=10) and 1,200 parts by mass of polyester resin (RS801 manufactured by Sanyo Chemical Industries) were mixed together by a Henschel mixer (manufactured by Mitsui Mining). The mixture was kneaded at 150° C. for 30 min by a two-roll mill. Subsequently, the kneaded product was rolled and cooled and then pulverized by a pulverizer to form a master batch. This product was designated as Master Batch 1.

-Preparation of Oil Phase- 300 parts by mass of Low-Molecular-Weight Polyester 1, 90 parts by mass of carnauba wax, 10 parts by mass of rice wax and 1,000 parts by mass of ethyl acetate were added to a reaction vessel equipped with a stirring bar and a thermometer. The mixture was stirred at 79° C. to dissolve the solutes and then rapidly cooled to 4° C. The resulting mixture was placed in a bead mill (ULTRAVISCOMILL manufactured by Aimex) and the mill was operated under the following conditions to disperse the components: liquid feed speed=1 kg/hr, disk circumferential speed=6 m/sec, filled with 0.5 mm zirconia beads to 80% by volume, 3 passes. This gave a wax dispersion with a volume-average particle size of 0.6 μm.

500 parts by mass of Master Batch 1 and 640 parts by mass of a 70% by mass ethyl acetate solution of Low-Molecular-Weight Polyester 1 were then added and the mixture was mixed for 10 hours. Subsequently, the mixture was passed through the bead mill 5 times and ethyl acetate was added to adjust the solid content to 50% by mass. This gave Oil Phase 1.

-Preparation of Polymerization Toner- 73.2 parts by mass of Oil Phase 1, 6.8 parts by mass of Prepolymer 1 and 0.48 parts by mass of Ketimine Compound 1 were added to a vessel and thoroughly mixed to obtain Emulsified Oil Phase 1. To the emulsion, 120 parts by mass of Aqueous Phase 1 were added and the mixture was mixed in a homomixer for 1 min. The mixture was then converged while being slowly stirred with a paddle for 1 hour to form Emulsified Slurry 1.

Emulsified Slurry 1 was stripped of solvents at 30° C. for 1 hour and was subsequently aged at 60° C. for 5 hours. The aged product was washed with water, filtrated and then dried. The dried product was passed through a sieve with 75 μm mesh to obtain toner base particles having a volume-average particle size of 6.1 μm, a number-average particle size of 5.4 μm and an average circularity of 0.972.

0.7 parts by mass of hydrophobic silica and 0.3 parts by mass of hydrophobicized titanium oxide were mixed with 100 parts by mass of the obtained toner base particles in a Henschel mixer. This gave Toner 3.

Preparation of carriers for use in Examples 1 through 8 and Comparative Examples 1 and 2 will now be described.

-Preparation of Carrier 1-

7 parts by mass of silicone resin A (solvent-stripped product of SR2410, manufactured by Dow Corning Toray) and 100 parts by mass of a ferrite core material having a volume-average particle size of 35 μm (saturation magnetic moment at 1 k gauss=65 emu/g) were added to the carrier treatment tank (inner volume=400 ml) of the carrier production apparatus shown in FIG. 1. While the mixture was kept stirred, the valve was opened and carbon dioxide (purity=99.5%, manufactured by Gastec Service) was fed to the carrier treatment tank through the pressure pump until the conditions inside the tank reached 25 MPa and 40° C., at which point the valve was closed.

After the conditions inside the carrier treatment tank were maintained at 25 MPa and 40° C. for 2 hours, the valve was opened and the tank pressure was released via the reducing pump down to the atmospheric pressure over 2 hours. The carrier treatment tank was then heated at 160° C. for 2 hours (resin coating layer deposition step). The unused coating material could be collected from the raw material collection tank for recycling.

Next, 10 parts by mass of ferric chloride to serve as the treatment agent were added to the carrier treatment tank. With the contents kept stirred, the valve was opened and carbon dioxide (purity=99.5%, manufactured by Gastec Service) was fed to the tank through the pressure pump until the conditions inside the tank reached 25 MPa and 40° C., at which point the valve was closed.

Subsequently, the conditions inside the carrier treatment tank were maintained at those required for the treatment (20 MPa, 40° C.) for 1 hour. The valve was then opened and the tank pressure was released via the reducing pump down to the atmospheric pressure over 2 hours (resin coating layer treatment step). The unused ferric chloride could be collected from the raw material collection tank for recycling.

Next, 10 parts by mass of pyrrole to serve as the conductor precursor were added to the carrier treatment tank. With the contents kept stirred, the valve was opened and carbon dioxide (purity=99.5%, manufactured by Gastec Service) was fed to the tank through the pressure pump until the conditions inside the tank reached 25 MPa and 40° C., at which point the valve was closed.

Subsequently, the conditions inside the carrier treatment tank were maintained at Treatment Condition 1 (20 MPa, 40° C.) for 1 hour. The valve was then opened and the tank pressure was released via the reducing pump down to the atmospheric pressure over 2 hours (conductor formation step). The unused pyrrole could be collected from the raw material collection tank for recycling.

The above-described process gave Carrier 1.

Carrier 1 so obtained was analyzed for the thickness and the electrical resistance of the resin coating layer in the manner described below. The analysis revealed that the resin coating layer deposited on Carrier 1 had a thickness of 0.55 μm and an electrical resistance (Log R) of 13.2 Ω·m.

<Measurement of Thickness of Resin Coating Layer>

The cross-section of carrier was observed by transmission electron microscopy (TEM) to determine the thickness of the resin coating layer.

<Measurement of Electric Resistance of Carrier>

The electrical resistance of carrier was determined as follows: carrier was packed in a container containing two parallel electrodes that are spaced apart by 2 mm. A voltage of 50 V was then applied between the two electrodes and the direct current resistance was measured by a resistance meter (4329A High Resistance Meter manufactured by Yokogawa Hewlett Packard).

-Preparation of Carrier 2-

Carrier 2 was prepared in the same manner as in the preparation of Carrier 1, except that silicone resin A was replaced by silicone resin B (KR-220L, Shin-Etsu Chemical). Carrier 2 so obtained had a resin coating layer thickness of 0.52 μm and an electrical resistance (Log R) of 13.2 Ω·m, as determined as described in the preparation of Carrier 1.

-Preparation of Carrier 3-

Carrier 3 was prepared in the same manner as in the preparation of Carrier 1, except that pyrrole used as the polymer precursor was replaced by aniline.

Carrier 3 so obtained had a resin coating layer thickness of 0.54 μm and an electrical resistance (Log R) of 13.4 Ω·m, as determined as described in the preparation of Carrier 1.

-Preparation of Carrier 4-

Carrier 4 was prepared in the same manner as in the preparation of Carrier 2, except that pyrrole used as the polymer precursor was replaced by aniline.

Carrier 4 so obtained had a resin coating layer thickness of 0.52 μm and an electrical resistance (Log R) of 13.5 Ω·m, as determined as described in the preparation of Carrier 1.

-Preparation of Carrier 5-

Carrier 5 was prepared in the same manner as in the preparation of Carrier 1, except that Treatment Condition 1 was replaced by Treatment Condition 2 (30 MPa, 40° C.).

Carrier 5 so obtained had a resin coating layer thickness of 0.50 μm and an electrical resistance (Log R) of 12.8 Ω·m, as determined as described in the preparation of Carrier 1.

-Preparation of Carrier 6-

A dispersion composed of 1,000 parts by mass of a toluene solution of silicone resin A (10% by mass solid content) and 5 parts by mass of a catalyst ($(CH_3)_2Sn(OCOCH_3)_2$) was stirred. Using a fluidized bed coater, the stirred dispersion was applied to 5,000 parts by mass of a ferrite core material having a volume-average particle size of 35 μm (saturation magnetic moment at 1 k gauss=65 emu/g) in a 100° C. atmosphere at a rate of 50 g/min over 20 min. The resulting silicone resin-coated ferrite particles were heated at 200° C. for 1 hour (resin coating layer deposition step).

Next, 10 parts by mass of ferric chloride to serve as the treatment agent were added to the carrier treatment tank as shown in FIG. 1. With the contents kept stirred, the valve was opened and carbon dioxide (purity=99.5%, manufactured by Gastec Service) was fed to the tank through the pressure pump until the conditions inside the tank reached 25 MPa and 40° C., at which point the valve was closed.

Subsequently, the conditions inside the carrier treatment tank were maintained at Treatment Condition 1 (20 MPa, 40° C.) for 1 hour. The valve was then opened and the tank pressure was released via the reducing pump down to the atmospheric pressure over 2 hours (resin coating layer treatment step). The unused ferric chloride could be collected from the raw material collection tank for recycling.

Next, 10 parts by mass of pyrrole to serve as the conductor precursor were added to the carrier treatment tank. With the contents kept stirred, the valve was opened and carbon dioxide (purity=99.5%, manufactured by Gastec Service) was fed to the tank through the pressure pump until the conditions inside the tank reached 25 MPa and 40° C., at which point the valve was closed.

Subsequently, the conditions inside the carrier treatment tank were maintained at Treatment Condition 1 (20 MPa, 40° C.) for 1 hour. The valve was then opened and the tank pressure was released via the reducing pump down to the atmospheric pressure over 2 hours (conductor formation step). The unused pyrrole could be collected from the raw material collection tank for recycling.

The above-described process gave Carrier 6.

Carrier 6 so obtained had a resin coating layer thickness of 0.60 μm and an electrical resistance (Log R) of 13.6 Ω·m, as determined as described in the preparation of Carrier 1.

-Preparation of Comparative Carrier 1-

A dispersion composed of 1,000 parts by mass of a toluene solution of silicone resin A (10% by mass solid content), 5 parts by mass of a catalyst ($(CH_3)_2Sn(OCOCH_3)_2$) and 50 parts by mass of alumina (SUMICORUNDUM AA-04 manufactured by Sumitomo Chemical, 0.4 μm, aspect ratio=1.1) was stirred. Using a fluidized bed coater, the stirred dispersion was applied to 5,000 parts by mass of a ferrite core material having a volume-average particle size of 35 μm (saturation magnetic moment at 1 k gauss=65 emu/g) in a 100° C. atmosphere at a rate of 50 g/min over 20 min.

The resulting silicone resin-coated ferrite particles were heated at 200° C. for 1 hour to give Comparative Carrier 1.

Comparative Carrier 1 so obtained had a resin coating layer thickness of 0.62 μm and an electrical resistance (Log R) of 14.2 Ω·m, as determined as described in the preparation of Carrier 1.

-Preparation of Comparative Carrier 2-

A dispersion composed of 1,000 parts by mass of a toluene solution of silicone resin A (10% by mass solid content) and 5 parts by mass of a catalyst ($(CH_3)_2Sn(OCOCH_3)_2$) was stirred. Using a fluidized bed coater, the stirred dispersion was applied to 5,000 parts by mass of a ferrite core material having a volume-average particle size of 35 μm (saturation magnetic moment at 1 k gauss=65 emu/g) in a 100° C. atmosphere at a rate of 50 g/min over 20 min.

The resulting silicone resin-coated ferrite particles were heated at 200° C. for 1 hour (resin coating layer deposition step).

Next, the silicone resin-coated ferrite particles and 10 parts by mass of pyrrole to serve as the polymer precursor were sequentially added to the carrier treatment tank (internal volume=400 ml) of the carrier production apparatus shown in FIG. 1. With the contents kept stirred, the valve was opened and carbon dioxide (purity=99.5%, manufactured by Gastec Service) was fed to the tank through the pressure pump until the conditions inside the tank reached 25 MPa and 40° C., at which point the valve was closed.

Subsequently, the conditions inside the carrier treatment tank were maintained at Treatment Condition 1 (20 MPa, 40° C.) for 1 hour. The valve was then opened and the tank pressure was released via the reducing pump down to the atmospheric pressure over 2 hours (resin layer treatment step). The unused pyrrole could be collected from the raw material collection tank for recycling. The overall process gave Comparative Carrier 2.

Comparative Carrier 2 so obtained had a resin coating layer thickness of 0.62 μm and an electrical resistance (Log R) of 17.0 Ω·m, as determined as described in the preparation of Carrier 1.

Examples 1 through 8 and Comparative Examples 1 and 2

-Preparation of Developer-

Developers of Examples 1 through 8 and Comparative Examples 1 and 2 were prepared by combining Carriers 1 through 6 and Comparative Carriers 1 and 2 with Toners 1 through 3 as shown in Table 1 below, and using a common technique for making developer.

The resulting developers were each evaluated for their image density, toner scattering, background depositions and edge effect. The results are shown in Table 1.

<Image Density>

Each developer was used on a tandem color image forming apparatus (IMAGIO NEO 450 manufactured by Ricoh) to form a solid image on a sheet of copy paper (TYPE 6000 (70W) manufactured by Ricoh) with the developer deposited in an amount of 1.00±0.05 mg/cm$^2$. Each developer was used to repeatedly form the same solid image on 1,000,000 sheets of the copy paper.

The image density of the solid image was visually observed at the beginning and after 1,000,000 sheets of continuous use of each developer and was rated based on the standard given below. In general, a higher image density rating gives an image of a higher quality. This evaluation corresponds to Examples of the developer and image forming method of the present invention.

[Evaluation Standard]

A: No change was observed in the image density between at the beginning and after 1,000,000 sheets of continuous use and high image quality was achieved.

B: A slight decrease was observed in the image density after 1,000,000 sheets of continuous use but high image quality was still achieved.

C: A moderate decrease was observed in the image density after 1,000,000 sheets of continuous use, resulting in decreased image quality.

D: A significant decrease was observed in the image density after 1,000,000 sheets of continuous use, resulting in a significant decrease in the decreased image quality.

<Toner Scattering>

A tandem color image forming apparatus (IMAGIO NEO 450 manufactured by Ricoh) was continuously operated to form a chart having a 5% image area on 1,000,000 sheets of paper and the degree of contamination of the apparatus with toner was visually rated on a 4-step scale based on the following standard:

[Evaluation Standard]

A: The apparatus was not contaminated with toner and in excellent condition.

B: The apparatus was not contaminated with toner and in good condition.

C: The apparatus was contaminated with toner, but only to a level that allows practical operation of the apparatus.

D: The apparatus was so severely contaminated with toner that it can no longer be practically used.

<Background Deposition>

A tandem color image forming apparatus (IMAGIO NEO 450 manufactured by Ricoh) was continuously operated to form a chart having a 5% image area on 1,000,000 sheets of paper and the degree of deposition (smears) in the background of the image was visually rated based on the following standard:

[Evaluation Standard]

A: No smears in the image background.

B: Some smears in the image background.

C. Significant smears in the image background.

<Edge Effect>

Each developer was loaded on a modified version of a commercial digital full color printer (IPSIO CX8200 manufactured by Ricoh) and a large area test pattern was printed. The resulting image was rated based on the following standard for the difference in density between an area near the center of the pattern and an area near the edge of the pattern.

[Evaluation Standard]

A: No difference in density.

B: A slight difference in density.

C: A acceptable difference in density.

D: An unacceptable difference in density.

<Overall Rating>

Each developer was rated based on the overall rating with regard to the above-described standards and was given a rating on the following scale:

[Evaluation Standard]

A: Excellent

B: Good

C: Poor

TABLE 1

| | | | Image density | Toner scattering | Background deposition | Edge effct | Overall rating |
|---|---|---|---|---|---|---|---|
| Ex. 1 | Carrier 1 | Toner 3 | A | A | A | B | A |
| Ex. 2 | Carrier 1 | Toner 2 | A | A | A | B | A |
| Ex. 3 | Carrier 1 | Toner 1 | A | A | A | B | A |
| Ex. 4 | Carrier 2 | Toner 3 | A | B | A | B | B |
| Ex. 5 | Carrier 3 | Toner 3 | A | B | A | B | B |
| Ex. 6 | Carrier 4 | Toner 3 | A | B | A | B | B |
| Ex. 7 | Carrier 5 | Toner 3 | A | A | A | A | A |
| Ex. 8 | Carrier 6 | Toner 3 | A | B | A | B | B |
| Comp. Ex. 1 | Comp. Carrier 1 | Toner 3 | D | D | C | D | C |
| Comp. Ex. 2 | Comp. Carrier 2 | Toner 3 | D | D | C | D | C |

As described above, each of Carriers 1 through 6 used in the developers of Examples 1 through 8 is obtained by treating a resin coating layer deposited on a core material with a polymer precursor in a supercritical fluid, and then oxidizing the resin coating layer. The results of Table 1 indicate that the developers of Examples 1 through 8 each exhibit a significant reduction in each of the evaluated properties (i.e., toner scattering, background depositions and edge effect), as compared to the developers of Comparative Examples 1 and 2. Thus, each of the developers of Examples 1 through 8 has been proven to be effective in providing fine, high-quality images for a long time.

What is claimed is:

1. A method for producing a carrier, comprising:

depositing a resin coating layer on a surface of a magnetic material;

adding a treatment agent for a conductor precursor to the resin coating layer so as to treat the resin coating layer with the treatment agent;

exposing the treatment agent-added resin coating layer to a conductor precursor in a supercritical or subcritical fluid in the resin coating layer; and converting the conductor precursor into a conductor in the resin coating layer.

2. The method according to claim 1, wherein the step of depositing resin coating layer comprises dissolving or dispersing a resin for the resin coating layer in a supercritical or subcritical fluid to deposit the resin coating layer on the surface of the magnetic material.

3. The method according to claim 1, wherein the conductor is metal particles.

4. The method according to claim 3, wherein the conductor precursor is an organic metal complex.

5. The method according to claim 1, wherein the conductor is a polymer.

6. The method according to claim 5, wherein the conductor precursor is a compound containing a 5-membered aromatic structure or an aniline structure.

7. The method according to claim 6, wherein the compound containing a 5-membered aromatic structure is pyrrole or a derivative of pyrrole.

8. The method according to claim 1, wherein the adding the treatment agent is carried out in a supercritical or subcritical fluid.

9. The method according to claim 1, wherein the supercritical or subcritical fluid is carbon dioxide.

* * * * *